US012433331B2

(12) United States Patent
Kim et al.

(10) Patent No.: US 12,433,331 B2
(45) Date of Patent: Oct. 7, 2025

(54) ATOMIZATION ASSEMBLY, CARTRIDGE, AND AEROSOL GENERATING DEVICE INCLUDING THE SAME

(71) Applicant: KT&G CORPORATION, Daejeon (KR)

(72) Inventors: Dong Sung Kim, Seoul (KR); Heon Jun Jeong, Seoul (KR); Won Kyeong Lee, Gyeonggi-do (KR); Jae Sung Choi, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 443 days.

(21) Appl. No.: 17/794,353

(22) PCT Filed: Nov. 25, 2021

(86) PCT No.: PCT/KR2021/017524

§ 371 (c)(1),
(2) Date: Jul. 21, 2022

(87) PCT Pub. No.: WO2022/119239

PCT Pub. Date: Jun. 9, 2022

(65) Prior Publication Data

US 2023/0081109 A1 Mar. 16, 2023

(30) Foreign Application Priority Data

Dec. 3, 2020 (KR) ..... 10-2020-0167665
Dec. 3, 2020 (KR) ..... 10-2020-0167666
(Continued)

(51) Int. Cl.
*A24F 40/10* (2020.01)
*A24F 40/30* (2020.01)
(Continued)

(52) U.S. Cl.
CPC ..... *A24F 40/10* (2020.01); *A24F 40/30* (2020.01); *A24F 40/42* (2020.01); *A24F 40/50* (2020.01)

(58) Field of Classification Search
None
See application file for complete search history.

(56) References Cited

U.S. PATENT DOCUMENTS 10,328,443 B2 6/2019 Ricketts et al.
10,506,827 B2 12/2019 Guo et al.
(Continued)

FOREIGN PATENT DOCUMENTS

CN 105916399 A 8/2016
CN 209732616 U 12/2019
(Continued)

OTHER PUBLICATIONS

International Search Report for PCT/KR2021/017524 dated Mar. 2, 2022.
(Continued)

*Primary Examiner* — Parviz Hassanzadeh
(74) *Attorney, Agent, or Firm* — Sughrue Mion, PLLC

(57) ABSTRACT

An atomization assembly for an aerosol generating device includes an atomizer configured to atomize an aerosol generating material to generate an aerosol, a first liquid delivery element configured to absorb an aerosol generating material from a reservoir for storing the aerosol generating material, and a second liquid delivery element arranged between the first liquid delivery element and the atomizer and configured to deliver the aerosol generating material absorbed by the first liquid delivery element to the atomizer.

6 Claims, 27 Drawing Sheets

(30) Foreign Application Priority Data

Feb. 4, 2021 (KR) ..... 10-2021-0016285
Feb. 16, 2021 (KR) ..... 10-2021-0020683

(51) Int. Cl.
*A24F 40/42* (2020.01)
*A24F 40/50* (2020.01)

(56) References Cited

U.S. PATENT DOCUMENTS

| | | | | |
|---|---|---|---|---|
| 10,561,803 | B2 | 2/2020 | Liu et al. | |
| 11,039,640 | B2 | 6/2021 | Liu et al. | |
| 11,325,149 | B2 | 5/2022 | Tan et al. | |
| 2011/0277757 | A1 | 11/2011 | Terry et al. | |
| 2016/0353802 | A1* | 12/2016 | Malgat | A24F 40/70 |
| 2017/0035112 | A1 | 2/2017 | Thorens | |
| 2018/0325169 | A1* | 11/2018 | Guo | A24F 40/05 |
| 2019/0230986 | A1 | 8/2019 | Zinovik et al. | |
| 2020/0000151 | A1 | 1/2020 | Fraser et al. | |
| 2021/0037886 | A1 | 2/2021 | Mironov et al. | |
| 2021/0401044 | A1 | 12/2021 | Qiu et al. | |
| 2023/0126886 | A1 | 4/2023 | Batista et al. | |

FOREIGN PATENT DOCUMENTS

| | | | |
|---|---|---|---|
| CN | 111685370 | A | 9/2020 |
| EP | 3 603 427 | A1 | 2/2020 |
| EP | 3 622 838 | A2 | 3/2020 |
| JP | 2010-142737 | A | 7/2010 |
| JP | 2017-507647 | A | 3/2017 |
| JP | 2019-515692 | A | 6/2019 |
| KR | 10-2017-0108057 | A | 9/2017 |
| KR | 10-2018-0021689 | A | 3/2018 |
| KR | 10-2018-0129929 | A | 12/2018 |
| KR | 10-2019-0112304 | A | 10/2019 |
| KR | 10-2047202 | B1 | 11/2019 |
| KR | 10-2148092 | B1 | 8/2020 |
| WO | 2015/079197 | A1 | 6/2015 |
| WO | 2020/003305 | A1 | 1/2020 |

OTHER PUBLICATIONS

Written Opinion for PCT/KR2021/017524 dated Mar. 2, 2022.
Chinese Office Action dated Jun. 1, 2024 in Application No. 202180011610.X.
Office Action issued Dec. 15, 2022 in Korean Application No. 10-2021-0016285.
Extended European Search Report issued Dec. 16, 2022 in European Application No. 21900927.1.
Japanese Office Action dated Aug. 8, 2023 in Application No. 2022-549562.
Communication dated Feb. 27, 2025 in European Application No. 21 900 927.1.

* cited by examiner

ATOMIZATION ASSEMBLY, CARTRIDGE, AND AEROSOL GENERATING DEVICE INCLUDING THE SAME

CROSS REFERENCE TO RELATED APPLICATIONS

This application is a National Stage of International Application No. PCT/KR2021/017524 filed Nov. 25, 2021, claiming priority based on Korean Patent Application No. 10-2020-0167665 filed Dec. 3, 2020; Korean Patent Application No. 10-2020-0167666 filed Dec. 3, 2020; Korean Patent Application No. 10-2021-0016285 filed Feb. 4, 2021 and Korean Patent Application No. 10-2021-0020683 filed Feb. 16, 2021.

TECHNICAL FIELD

The embodiments relate to an atomization assembly, a cartridge, and an aerosol generating device including the same, and more particularly, to an atomization assembly capable of generating an aerosol by using ultrasonic vibrations, a cartridge, and an aerosol generating device including the same.

BACKGROUND ART

In recent years, there has been an increasing demand for technology to replace a method of supplying an aerosol by burning a general cigarette. For example, research has been conducted to supply an aerosol having flavor by generating an aerosol from an aerosol generating material in a liquid or solid state and then passing the aerosol through a solid fragrance medium.

DISCLOSURE OF INVENTION

Technical Problem

Aerosol generating devices generally generate aerosols by heating aerosol generating materials in a liquid or solid state by using heaters. It is important to heat aerosol generating materials to an appropriate temperature to supply good-tasting aerosols to users. However, aerosol generating devices using the heaters often heat the aerosol generating materials to overly high temperatures (for example, about 200° C. or higher). In this case, users may experience a burnt taste during smoking.

Problems to be solved by the embodiments according to the present disclosure are not limited to the problems described above, and problems not described may be clearly understood by those skilled in the art to which the embodiments belong from the present specification and the accompanying drawings.

Solution to Problem

The present disclosure provides an aerosol generating device including a cartridge capable of generating an aerosol by using ultrasonic vibrations, thereby generating an aerosol at a relatively low temperature (for example, about 100° C. to about 160° C.) compared to an aerosol generating device using a heater.

An atomization assembly for an aerosol generating device according to one embodiment includes an atomizer configured to atomize an aerosol generating material to generate an aerosol, a first liquid delivery element configured to absorb an aerosol generating material from a reservoir for storing the aerosol generating material, and a second liquid delivery element arranged between the first liquid delivery element and the atomizer and configured to deliver the aerosol generating material absorbed by the first liquid delivery element to the atomizer.

A cartridge according to one embodiment includes a housing, a reservoir that is located inside the housing and stores a liquid aerosol generating material, an atomizer that is located inside the housing and generates ultrasonic vibrations to atomize the aerosol generating material into an aerosol, and a plurality of liquid delivery elements configured to absorb the aerosol generating material stored in the reservoir and deliver the absorbed aerosol generating material to the atomizer.

An aerosol generating device according to one embodiment includes the cartridge described above, a main body connected to the cartridge, a battery that is arranged inside the main body and supplies electric power to the cartridge, and a processor that is arranged inside the main body and controls the electric power supplied to the cartridge from the battery.

Advantageous Effects of Invention

The aerosol generating device according to the embodiments may generate an aerosol at a relatively low temperature compared to a method of heating an aerosol generating material through a heater, and thus a user's smoking sensation may be improved.

In addition, the cartridge and the aerosol generating device according to the embodiments described above, may prevent droplets from splattering to a user during atomization of an aerosol, and thus a user's smoking sensation may be improved.

In addition, the cartridge and the aerosol generating device according to the embodiments may prevent an aerosol generating material from leaking, and thus a failure or an abnormal operation of the aerosol generating device may be reduced.

Effects of the embodiments are not limited to the effects described above, and effects not described may be clearly understood by those skilled in the art to which the embodiments belong from the present specification and the accompanying drawings.

MODE FOR THE INVENTION

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

The term "aerosol" described in the specification means a gas in a state in which vaporized particles generated from aerosol generating material and air are mixed.

In addition, the term "aerosol generating device" described in the specification means device that generates the aerosol by using the aerosol generating material such that the aerosol can be inhaled directly into a user's lungs through the user's mouth.

The term "puff" described in the specification means inhalation by the user, and inhalation means a situation in which the aerosol is drawn into the user's mouth, nasal cavity, or lungs through the user's mouth or nose.

It will be understood that when an element or layer is referred to as being "over," "above," "on," "connected to" or "coupled to" another element or layer, it can be directly over, above, on, connected or coupled to the other element or layer, or intervening elements or layers may be present in between.

Hereinafter, the present disclosure will now be described more fully with reference to the accompanying drawings, in which exemplary embodiments of the present disclosure are shown such that one of ordinary skill in the art may easily work the present disclosure.

Figure 1:
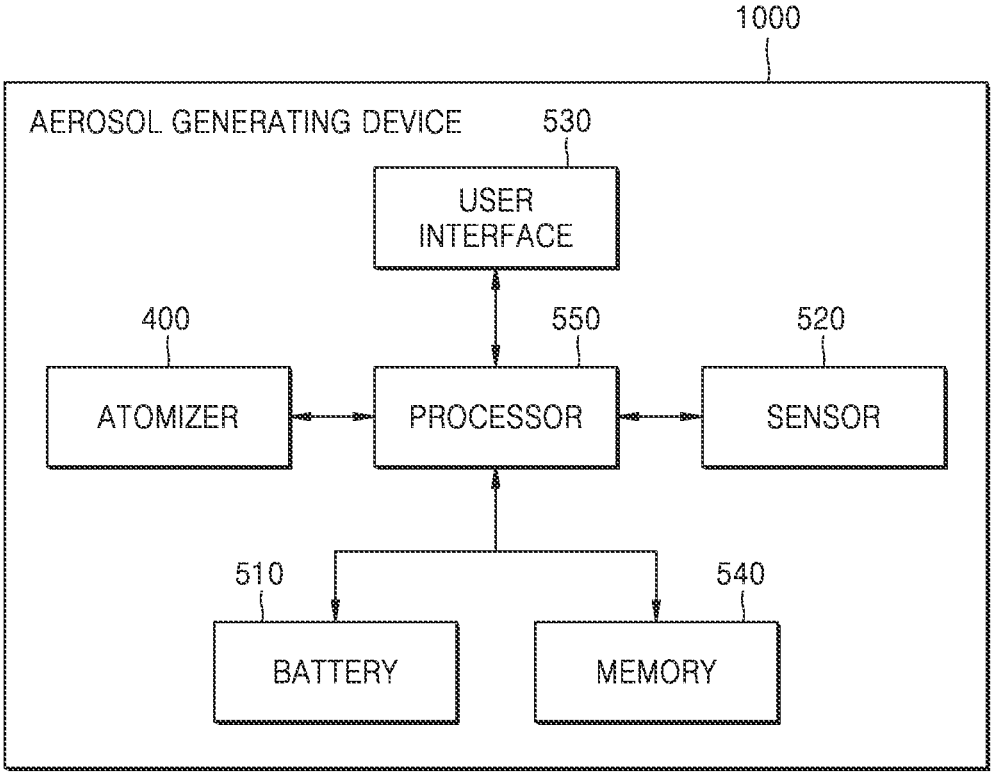
FIG. 1 is a block diagram of an aerosol generating device according to an embodiment.

FIG. 1 is a block diagram of an aerosol generating device according to an embodiment.

Referring to FIG. 1, the aerosol generating device 1000 may include an atomizer 400, a battery 510, a sensor 520, a user interface 530, a memory 540 and a processor 550. However, the internal structure of the aerosol generating device 1000 is not limited to the structures illustrated in FIG. 1. According to the design of the aerosol generating device 1000, it will be understood by one of ordinary skill in the art that some of the components shown in FIG. 1 may be omitted or new components may be added.

In an embodiment, the aerosol generating device 1000 may consist of only a main body, in which case components included in the aerosol generating device 1000 are located in the main body.

In another embodiment, the aerosol generating device 1000 may consist of a main body and a cartridge, in which case components included in the aerosol generating device 1000 are located separately in the main body and the cartridge. Alternatively, at least some of components included in the aerosol generating device 1000 may be located respectively in the main body and the cartridge.

Hereinafter, an operation of each of the components will be described without being limited to the location in a particular space in the aerosol generating device 1000.

The atomizer 400 receives power from the battery 510 under the control of the processor 550. The atomizer 400 may receive power from the battery 510 and atomize the aerosol generating material stored in the aerosol generating device 1000.

The atomizer 400 may be located in the main body of the aerosol generating device 1000. Alternatively, when the aerosol generating device 1000 consists of the main body and the cartridge, the atomizer 400 may be located in the cartridge. When the atomizer 400 is located in the cartridge, the atomizer 400 may receive power from the battery 510 located in at least one of the main body and the cartridge. In addition, when the atomizer 400 is located separately in the main body and the cartridge, components requiring power supply in the atomizer 400 may receive power from battery 510 located in at least one of the main body and the cartridge.

The atomizer 400 generate aerosol from the aerosol generating material inside the cartridge. The aerosol may refer to a gas in which vaporized particles generated from the aerosol generating material are mixed with air. Therefore, the aerosol generated from the atomizer 400 means a gas in which vaporized particles generated from the aerosol generating material are mixed with air. For example, the atomizer 400 performs a function of generating aerosol by converting the phase of the aerosol generating material inside the cartridge 20 to a gaseous phase. In addition, the atomizer 400 generates an aerosol by discharging the aerosol generating material in a liquid and/or solid phase into fine particles.

For example, the atomizer 400 generates the aerosol from the aerosol generating material by using an ultrasonic vibration method. The ultrasonic vibration method means a method of generating the aerosol by atomizing the aerosol generating material with ultrasonic vibration generated by a vibrator.

Although not shown in FIG. 1, the atomizer 400 may optionally include a heater capable of heating the aerosol generating material by generating heating. The aerosol generating material may be heated by the heater, such that the aerosol may be generated.

The heater may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater may be implemented by a metal wire, a metal plate on which an electrically conductive track is arranged, or a ceramic heating element, but is not limited thereto.

In an embodiment, the heater may be a component included in the cartridge. The cartridge may include the heater 130, the liquid delivery element, and the liquid storage. The aerosol generating material accommodated in the liquid storage may be moved to the liquid delivery element, and the heater may heat the aerosol generating material absorbed by the liquid delivery element, thereby generating aerosol. For example, the heater may include a material such as nickel chromium and may be wound around or arranged adjacent to the liquid delivery element.

In another embodiment, the aerosol generating device 1000 may include an accommodation space accommodating the aerosol generating article. The heater 130 may heat the aerosol generating article inserted into the accommodation space of the aerosol generating device 1000. As the aerosol generating article is accommodated in the accommodation space of the aerosol generating device 1000, the heater may be located inside and/or outside the aerosol generating article. Accordingly, the heater may generate aerosol by heating the aerosol generating material in the aerosol generating article Meanwhile, the heater may include an induction heater. The heater may include an electrically conductive coil for heating an aerosol generating article in an induction heating method, and the aerosol generating article or the cartridge may include a susceptor which may be heated by the induction heater.

The battery 510 supplies power to be used for the aerosol generating device 1000 to operate. In other words, the battery 510 may supply power such that the heater may be heated. In addition, the battery 510 may supply power required for operation of other components included in the aerosol generating device 1000, that is, the sensor 520, the user interface 530, the memory 540, and the processor 550. The battery 510 may be a rechargeable battery or a disposable battery.

For example, the battery 510 is a lithium-ion battery, a nickel-based battery (for example, a nickel-metal hydride battery, a nickel-cadmium battery), or a lithium-based battery (for example, a lithium-cobalt battery, a lithium-Phosphate battery, lithium titanate battery or lithium-polymer battery). However, the type of the battery 510 can be used in the aerosol generating device 100 is not limited by the above description. If necessary, the battery 510 may include an alkaline battery or a manganese battery.

The aerosol generating device 1000 may include at least one sensor 520. A result sensed by the at least one sensor 520 is transmitted to the processor 550, and the processor 550 may control the aerosol generating device 1000 to perform various functions such as controlling the operation of the heater, restricting smoking, determining whether an aerosol generating article (or a cartridge) is inserted, and displaying a notification.

For example, the at least one sensor 520 may include a puff sensor. The puff sensor may detect a user's puff based on any one of a temperature change, a flow change, a voltage change, and a pressure change. The puff sensor may detect a start timing and an end timing of the user's puff, and the processor 550 may determine a puff period and a non-puff period according to the detected start timing and end timing of the puff.

In addition, the at least one sensor 520 may include a user input sensor. The user input sensor may be a sensor capable of receiving a user's input, such as a switch, a physical button, or a touch sensor. For example, the touch sensor may be a capacitive sensor capable of detecting a user's input by detecting a change in capacitance when the user touches a predetermined area formed of a metal material. The process 550 may determine whether a user's input has occurred by comparing values before and after a change in capacitance received from the capacitive sensor. When the value before and after the change of capacitance exceeds the preset threshold, the processor 550 may determine that the user's input has occurred.

In addition, the at least one sensor 520 may include a motion sensor. The aerosol generating device 1000 may obtain information about the movement of the aerosol generating device 1000 such as inclination, moving speed, and acceleration of the aerosol generating device 1000 through the motion sensor. For example, the motion sensor may detect information regarding a state in which the aerosol generating device 1000 is moving, a state in which the aerosol generating device 1000 is stopped, a state in which the aerosol generating device 1000 is inclined at an angle within a predetermined range for puff, and a state in which the aerosol generating device 1000 is inclined at an angle different from that during the puff operation may be measured between each puff operation. The motion sensor may detect motion information of the aerosol generating device 1000 using various methods known in the art. For example, the motion sensor may include an acceleration sensor capable of measuring acceleration in three directions, an x-axis, a y-axis, and a z-axis, and a gyro sensor capable of measuring angular velocity in the three directions.

In addition, the at least one sensor 520 may include a proximity sensor. The proximity sensor means a sensor that may detect a presence or distance of an approaching object or an object existing in the vicinity without mechanical contact using the force of an electromagnetic field or infrared rays, etc. The aerosol generating device 1000 may detect whether the user approaches the aerosol generating device 1000 by using the proximity sensor.

In addition, the at least one sensor 520 may include an image sensor. For example, the image sensor may include a camera for acquiring an image of an object. The image sensor may recognize an object based on an image acquired by the camera. The processor 550 may determine whether the user is in a situation for using the aerosol generating device 1000 by analyzing the image acquired by the image sensor. For example, when the user approaches the aerosol generating device 1000 near the lips to use the aerosol generating device 1000, the image sensor may acquire an image of the lips. The processor 550 may determine that the user is in a situation to use the aerosol generating device 1000 based on determination that the acquired image is lips. Through the above-described operation of the processor 550, the aerosol generating device 1000 may operate the atomizer 400 in advance or preheat the heater.

In addition, the at least one sensor 520 may include a consumable detachment sensor capable of detecting installation or removal of consumables (e.g., cartridge, aerosol generating article, etc.) that can be used in the aerosol generating device 1000. For example, the consumables detachment sensor may detect whether the consumables are in contact with the aerosol generating device 1000 or determine whether the consumables are detached by the image sensor. In addition, the consumable detachment sensor may be an inductance sensor that detects a change in the inductance value of a coil capable of interacting with the marker of the consumable, or a capacitance sensor that detects a change in the capacitance value of a capacitor capable of interacting with the marker of the consumable.

In addition, the at least one sensor 520 may include a temperature sensor. The temperature sensor may detect the temperature at which the heater of the atomizer 400 (or an aerosol generating material) is heated. The aerosol generating device 1000 may include a separate temperature sensor for sensing a temperature of the heater, or the heater itself may serve as a temperature sensor instead of including a separate temperature sensor. Alternatively, a separate temperature sensor may be further included in the aerosol generating device 1000 while the heater serves as a temperature sensor. In addition, the temperature sensor may sense the temperature of internal components such as a printed circuit board (PCB) and a battery of the aerosol generating device 1000 as well as the heater.

In addition, the at least one sensor 520 may include various sensors that measure information on the surrounding environment of the aerosol generating device 1000. For example, the at least one sensor 520 may include a temperature sensor that can measure the temperature of the surrounding environment, a humidity sensor that measures the humidity of the surrounding environment, and an atmospheric pressure sensor that measures the pressure of the surrounding environment.

The at least one sensor 520 that may be provided in the aerosol generating device 1000 is not limited to the above-described type, and may further include various sensors. For example, the aerosol generating device 1000 includes a fingerprint sensor capable of acquiring fingerprint information from a user's finger for user authentication and security, an iris recognition sensor capable of analyzing the iris pattern of the pupil, a veil recognition sensor that detect the amount of infrared absorption of hemoglobin from an image of palm, a facial recognition sensor that recognizes feature points such as eyes, nose, mouth, and facial contour in a 2D or 3D method, and a Radio-Frequency Identification (RFID) sensor, etc.

In the aerosol generating device 1000, only some of the examples of the various sensors exemplified above may be selected and implemented. In other words, the aerosol generating device 1000 may combine and utilize information sensed by the above-described at least one sensor.

The user interface 530 may provide the user with information about the state of the aerosol generating device 1000. The user interface 530 may include various interfacing devices, such as a display or a light emitter for outputting visual information, a motor for outputting haptic information, a speaker for outputting sound information, input/output (I/O) interfacing devices (e.g., a button or a touch screen) for receiving information input from the user or outputting information to the user, terminals for performing data communication or receiving charging power, and communication interfacing modules for performing wireless communication (e.g., Wi-Fi, Wi-Fi direct, Bluetooth, near-field communication (NFC), etc.) with external devices.

However, the aerosol generating device 1000 may be implemented by selecting only some of the above-described examples of various user interface 530.

The memory 540, as a hardware component configured to store various pieces of data processed in the aerosol generating device 1000, may store data processed or to be processed by the processor 550. The memory 540 may include various types of memories; random access memory (RAM), such as dynamic random access memory (DRAM) and static random access memory (SRAM), etc.; read-only memory (ROM); electrically erasable programmable read-only memory (EEPROM), etc.

The memory 540 may store an operation time of the aerosol generating device 1000, the maximum number of puffs, the current number of puffs, at least one temperature profile, data on a user's smoking pattern, etc.

The processor 550 may generally control operations of the aerosol generating device 1000. The processor 550 can be implemented as an array of a plurality of logic gates or can be implemented as a combination of a general-purpose microprocessor and a memory in which a program executable in the microprocessor is stored. It will be understood by one of ordinary skill in the art that the processor 550 can be implemented in other forms of hardware.

The processor 550 analyzes a result of the sensing by at least one sensor 520, and controls the processes that are to be performed subsequently.

The processor 550 may control power supplied to the atomizer 400 so that the operation of the atomizer 400 is started or terminated, based on the result of the sensing by the at least one sensor 520. In addition, based on the result of the sensing by the at least one sensor 520, the processor 550 may control the amount of power supplied to the atomizer 400 and the time at which the power is supplied, so that the atomizer 400 is heated to a predetermined temperature or maintained at an appropriate temperature. For example, the processor 550 may control the power or voltage supplied to the atomizer 400, so that the vibrator of the atomizer 400 may vibrate at a predetermined frequency.

In an embodiment, the processor 550 may start the operation of the atomizer 400 after receiving a user input to the aerosol generating device 1000. In addition, the processor 550 may start the operation of the atomizer after detecting a user's puff by using the puff sensor. In addition, the processor 550 may stop supplying power to the atomizer 400 when the number of puffs reaches a preset number after counting the number of puffs by using the puff sensor.

The processor 550 may control the user interface 530 based on the result of the sensing by the at least one sensor 520. For example, when the number of puffs reaches the preset number after counting the number of puffs by using the puff sensor, the processor 550 may notify the user by using at least one of a light emitter, a motor, or a speaker that the aerosol generating device 1000 will soon be terminated.

Although not illustrated in FIG. 1, the aerosol generating device 1000 may form an aerosol generating system together with an additional cradle. For example, the cradle may be used to charge the battery 510 of the aerosol generating device 1000. For example, while the aerosol generating device 1000 is accommodated in an accommodation space of the cradle, the aerosol generating device 1000 may receive power from a battery of the cradle such that the battery 510 of the aerosol generating device 1000 may be charged.

Figure 2:
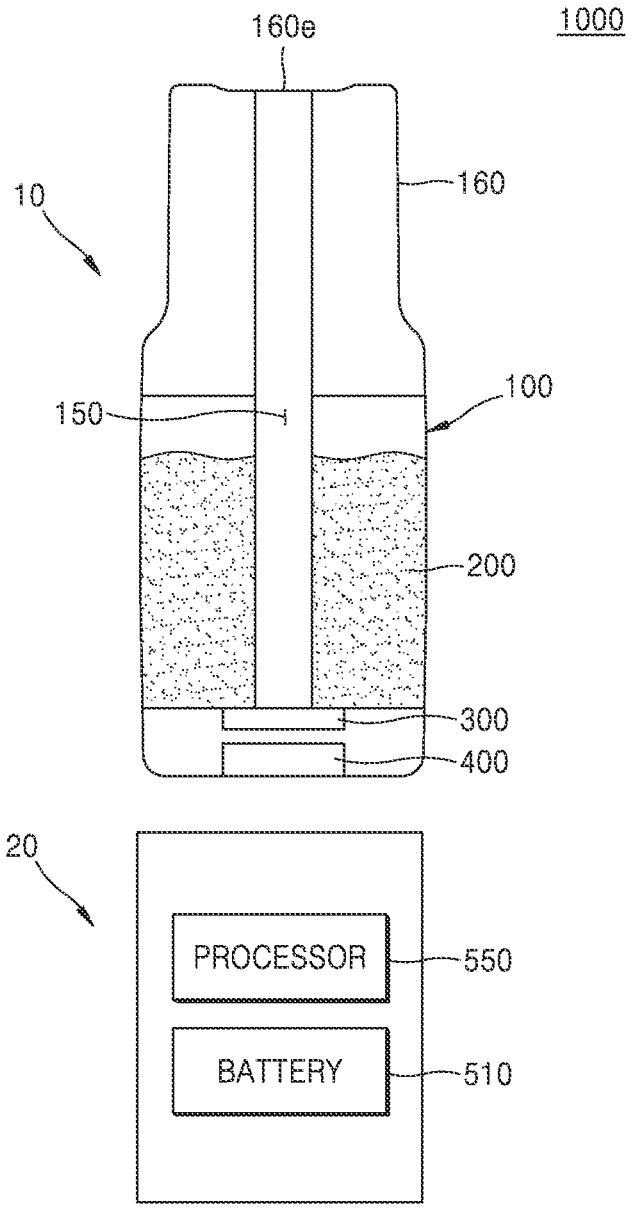
FIG. 2 is a view schematically illustrating the aerosol generating device illustrated in FIG. 1.

FIG. 2 is a view schematically illustrating the aerosol generating device according to an embodiment.

The aerosol generating device 1000 according to the embodiment illustrated in FIG. 2 includes a cartridge 10 including an aerosol generating material, and a main body 20 supporting the cartridge 10.

The cartridge 10 may be coupled to the main body 20 in a state in which an aerosol generating material is accommodated therein. For example, the cartridge 10 may be coupled to the main body 20 by inserting at least a part of the cartridge 10 into the main body 20. In another example, the cartridge 10 may be coupled to the main body 20 by inserting at least a part of the main body 20 into the cartridge 10.

The cartridge 10 may be coupled to the main body 20 by using at least one of a snap-fit method, a screw coupling method, a magnetic coupling method, and an interference fit method, and the coupling method of the cartridge 10 and the main body 20 is not limited to the example described above.

In one embodiment, the cartridge 10 may include a mouthpiece 160 that is inserted into a user's oral cavity during a user's inhalation. In one embodiment, the mouthpiece 160 may be in a region opposite to a region coupled to the main body 20 of the cartridge 10. The mouthpiece 160 may include an outlet 160*e* for discharging an aerosol generated from an aerosol generating material to the outside.

A pressure difference may be generated by between the outside and the inside of the cartridge 10 by a user's inhalation or puff, which may cause the aerosol generated inside the cartridge 10 to be discharged to the outside of the cartridge 10 through the outlet 160*e*. That is, the user may inhale an aerosol discharged to the outside of the cartridge 10 through the outlet 160*e*.

In one embodiment, the cartridge 10 may be arranged in the housing 100 and include a reservoir 200 for storing an aerosol generating material. In other words, the reservoir 200 may serve as a container for storing an aerosol generating material. The reservoir 200 may include an element containing an aerosol generating material, such as a sponge, cotton, cloth, or a porous ceramic structure.

The cartridge 10 may include an aerosol generating material having any one state, such as a liquid state, a solid state, a gaseous state, or a gel state. The aerosol generating material may include a liquid composition. For example, the liquid composition may be a liquid including a tobacco-containing material including a volatile tobacco flavor component or may be a liquid including a non-tobacco material.

The liquid composition may include any one component of water, a solvent, ethanol, a plant extract, a fragrance, a flavoring agent, and a vitamin mixture or may include a mixture of the components. The fragrance may include menthol, peppermint, spearmint oil, various fruit flavoring ingredients, and so on but is not limited thereto. The flavoring agent may include ingredients capable of providing a user with a variety of flavors or savors. The vitamin mixture may be a mixture of at least one of vitamin A, vitamin B, vitamin C, and vitamin E but is not limited thereto. The liquid composition may also include aerosol formers such as glycerin and propylene glycol.

For example, the liquid composition may include a solution of glycerin and propylene glycol in any weight ratio to which nicotine salt is added. The liquid composition may include two or more nicotine salts. The nicotine salts may be generated by adding a suitable acid, which includes organic acid or inorganic acid, to nicotine. The nicotine is either naturally occurring nicotine or synthetic nicotine and may have concentration of any suitable weight relative to the total solution weight of the liquid composition.

Acid for forming the nicotine salt may be appropriately selected by considering a blood nicotine absorption rate, an operation temperature of the aerosol generating device 1000, flavor, savor, solubility, and so on. For example, acid for forming the nicotine salt may be a single acid selected from a group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharinic acid, malonic acid, and malic acid, or two or more acids selected from the group but is not limited thereto.

The aerosol generating device 1000 may include an atomizer 400 that generates an aerosol by converting a phase of the aerosol generating material in the cartridge 10.

In one example, an aerosol generating material stored or accommodated in the reservoir 200 may be supplied to the atomizer 400 by the liquid delivery element 300, and the atomizer 400 may generate an aerosol by atomizing the aerosol generating material supplied from the liquid delivery element 300. The liquid delivery element 300 may be, for example, a wick including at least one of cotton fiber, ceramic fiber, glass fiber, and porous ceramic, but it is not limited thereto.

According to an embodiment, the atomizer 400 of the aerosol generating device 1000 may convert a phase of an aerosol generating material by atomizing the aerosol generating material with ultrasonic vibrations.

For example, the atomizer 400 may include a vibrator that generates vibrations of a short cycle, and the vibrations generated by the vibrator may be ultrasonic vibrations. A frequency of the ultrasonic vibrations may be about 100 kHz to about 3.5 MHz, but it is not limited thereto.

An aerosol generating material supplied from the reservoir 200 to the atomizer 400 may be atomized into an aerosol by vibrations of short cycles generated by a vibrator.

The vibrator may include, for example, a piezoelectric ceramic, and the piezoelectric ceramic may include a functional material capable of transducing a mechanical force (e.g., pressure) to electric power (e.g., voltage) or vice versa. That is, as electric power is applied to a vibrator, vibrations of a short cycle may be generated, and the generated vibrations may split an aerosol generating material into small particles and atomize the aerosol generating material.

The vibrator may be electrically connected to other components of the aerosol generating device 1000 through an electrical connection member. For example, the vibrator may be electrically connected to at least one of a battery 510, a processor 550, or a circuit of the aerosol generating device 1000 through an electrical connection member. The components connected to the vibrator is not limited to the example described above.

The vibrator may receive a current or a voltage from the battery 510 through an electrical connection member to generate ultrasonic vibrations, or an operation of the vibrator may be controlled by the processor 550.

The electrical connection member may include at least one of, for example, a pogo pin and a C-clip, and the electrical connection member is not limited to the example described above. In another example, the electrical connection member may also include at least one of a cable and a flexible printed circuit board (FPCB).

In another embodiment (not illustrated), the atomizer 400 may also be implemented by a vibration receiver having a mesh shape or a plate shape which performs a function of absorbing an aerosol generating material and maintain the aerosol generating material in an optimal state for conversion into an aerosol and generating an aerosol by transmitting vibrations to the aerosol generating material. In this case, a separate liquid delivery element 300 may not be required.

The drawings may illustrate only an embodiment in which the liquid delivery element 300 and the atomizer 400 are arranged in the cartridge 10, but embodiments are not limited thereto. In another embodiment, the liquid delivery element 300 may be in the cartridge 10, and the atomizer 400 may be in the main body 20.

The cartridge 10 of the aerosol generating device 1000 may include an outlet passage 150. The outlet passage 150 may provide fluid communication between the atomizer 400 and the outlet 160*e* of the mouthpiece 160. Accordingly, an aerosol generated by the atomizer 400 may flow along the outlet passage 150 and may be discharged to the outside of the aerosol generating device 1000 through the outlet 160*e* to be delivered to a user.

For example, the outlet passage 150 may be arranged inside of the cartridge 10 to be surrounded by the reservoir 200, but it is not limited thereto.

Although not illustrated in the drawings, the cartridge 10 of the aerosol generating device 1000 may include at least one air inlet passage for introducing air (i.e., external air from the outside) into the aerosol generating device 1000.

The external air may be introduced through at least one air inlet passage into the outlet passage 150 of the cartridge 10 or into a space in which an aerosol is generated by the atomizer 400. The introduced external air may be mixed with vaporized particles generated from the aerosol generating material, and thus an aerosol may be generated.

In the aerosol generating device 1000, a cross-section of the cartridge 10 cut in a direction transverse to a longitudinal direction of the cartridge 10 (or the main body 20) may be a circle, an oval, a square, a rectangle, or one of various polygons. However, a cross-sectional shape of the aerosol generating device 1000 is not limited to the shape described above. Also, the aerosol generating device 1000 is not limited to a linearly extending structure.

In another embodiment, the aerosol generating device 1000 may be formed in a streamline shape to be easily held by a user's hand or may be bent at a preset angle in a specific region. Also, the cross-sectional shape of the aerosol generating device 1000 may be changed along the longitudinal direction.

Figure 3:
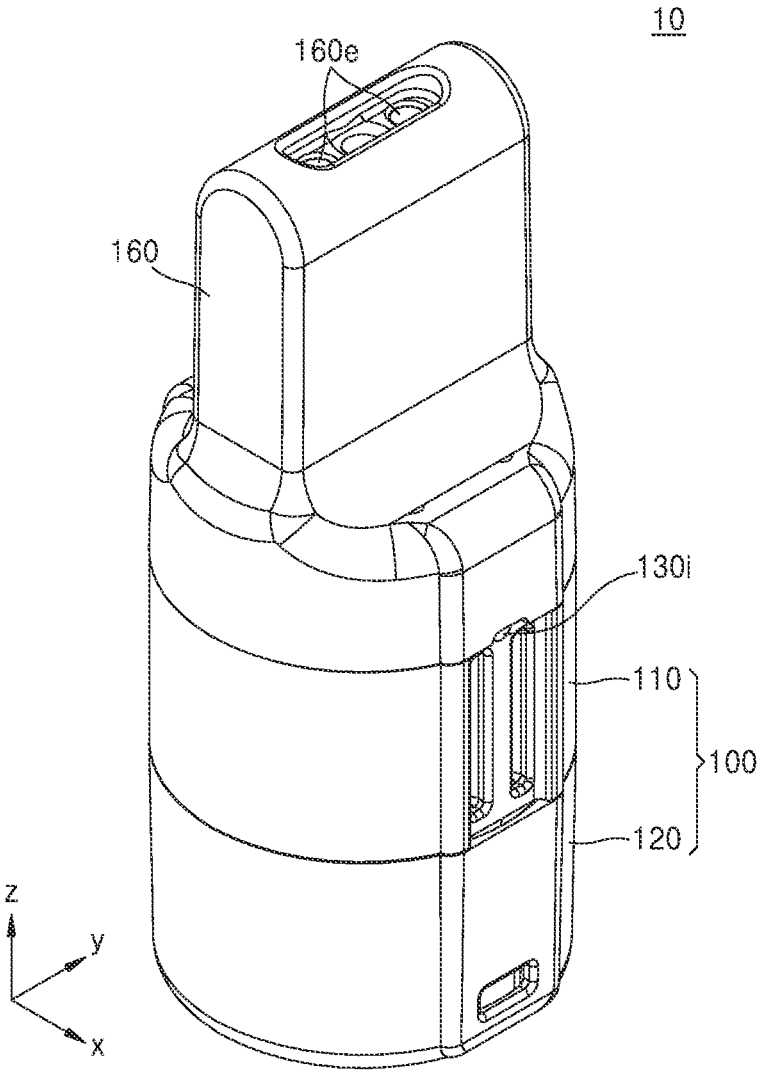
FIG. 3 is a perspective view of a cartridge for an aerosol generating device according to an embodiment.
Figure 4:
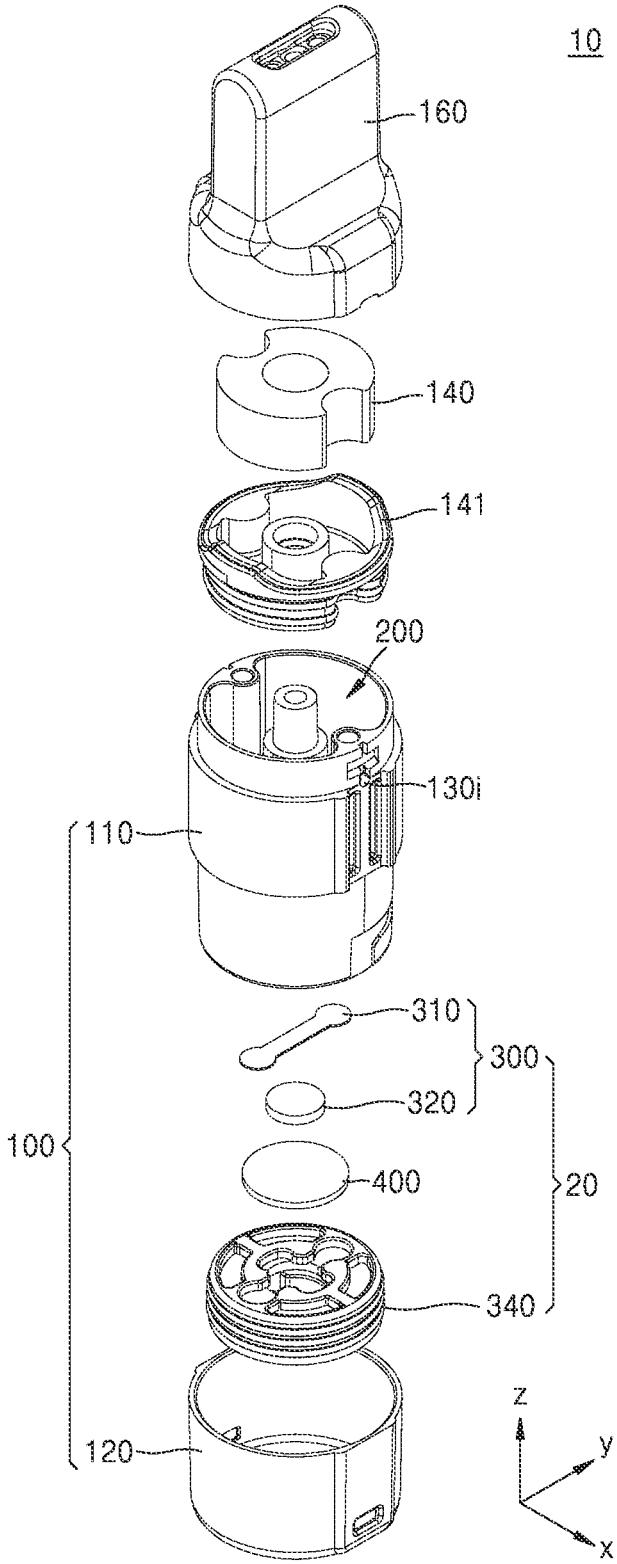
FIG. 4 is an exploded perspective view of a cartridge according to an embodiment.

FIG. 3 is a perspective view of a cartridge for an aerosol generating device according to an embodiment, and FIG. 4 is an exploded perspective view of the cartridge according to an embodiment.

The cartridge 10 shown FIGS. 3 and 4 may be used for the embodiment of FIG. 2, and redundant descriptions thereof are omitted.

Referring to FIGS. 3 and 4, the cartridge 10 according to the embodiment may include the housing 100 that forms the overall appearance of the cartridge 10 and the mouthpiece 160 connected to one region of the housing 100.

Constituent elements of the cartridge 10 are not limited to the example described above, and at least one configuration may be added thereto, or any one configuration (for example, the mouthpiece 160) may also be omitted depending on embodiments.

The housing 100 may include an inner space in which constituent elements of the cartridge 10 may be arranged and may form the overall appearance of the cartridge 10. The drawings illustrate only an embodiment in which the housing 100 has a cylindrical shape as a whole, but the shape of the housing 100 is not limited thereto. According to another embodiment (not illustrated), the housing 100 may also have a shape of a polygonal column (for example, a triangular column or a quadrangular column) as a whole.

According to one embodiment, the housing 100 may include a first housing 110 and a second housing 120 coupled to each other, and the first housing 110 and the second housing 110 may protect constituent elements of the cartridge 10 arranged in the first housing 110 and the second housing 120.

For example, the second housing 120 (or a "lower housing") may be coupled to a lower end (for example, the end portion in the −z direction) of the first housing 110 (or an "upper housing"), but it is not limited thereto.

In the present disclosure, "the lower end of the first housing" may indicate the end portion of the first housing 110 in the −z direction, and "the upper end of the first housing" may indicate the end portion of the first housing 110 in the +z direction.

The mouthpiece 160 may be inserted into a user's oral cavity. The mouthpiece 160 may be coupled to one region of the housing 100. For example, the mouthpiece 160 may be coupled to a region of the first housing 100 (for example, the upper region of the first housing 110) opposite to the region of the first housing 110 coupled to the second housing 120.

In one embodiment, the mouthpiece 160 may be detachably coupled to one region of the housing 100 but the mouthpiece 160 and the housing 100 may be integrally formed according to an embodiment.

The mouthpiece 160 may include at least one outlet 160*e* for discharging an aerosol generated inside the cartridge 10 to the outside of the cartridge 10. A user may have the user's oral cavity come into contact with the mouthpiece 160 to inhale an aerosol discharged through the outlet 160*e* of the mouthpiece 160.

The cartridge 10 may include a reservoir 200 (for example, the reservoir 200 in FIG. 2) arranged in an inner space of the housing 100, and an atomization assembly 20.

According to one embodiment, the reservoir 200 may be inside the first housing 110, and an aerosol generating material may be stored in the reservoir 200. For example, a liquid aerosol generating material may be stored in the reservoir 200, and the liquid aerosol generating material stored in the reservoir 200 may be delivered to the atomizer 400 by the liquid delivery element 300.

According to one embodiment, the atomization assembly 20 may include a liquid delivery element 300 (for example, the liquid delivery element 300 of FIG. 2) and an atomizer 400 (for example, the atomizer 400 in FIG. 2) to generate an aerosol from the aerosol generating material stored in the reservoir 200.

According to one embodiment, the liquid delivery element 300 may receive an aerosol generating material from the reservoir 200 and deliver the received aerosol generating material to the atomizer 400. For example, the liquid delivery element 300 may absorb an aerosol generating material moving from the reservoir 200 in a direction of the liquid delivery element 300, and the absorbed aerosol generating material may be moved along the liquid delivery element 300 to be supplied to the atomizer 400.

According to one embodiment, the liquid delivery element 300 may include a plurality of liquid delivery elements. For example, the liquid delivery element 300 may include a first liquid delivery element 310 and a second liquid delivery element 320.

The first liquid delivery element 310 may be adjacent to the reservoir 200 to receive a liquid aerosol generating material from the reservoir 200. For example, the first liquid delivery element 310 may receive an aerosol generating material from the reservoir 200 by absorbing at least a part of the aerosol generating material discharged from the reservoir 200.

The second liquid delivery element 320 may be disposed between the first liquid delivery element 310 and the atomizer 400 and deliver the aerosol supplied to the first liquid delivery element 310 to the atomizer 400.

For example, the first liquid delivery element 310 may be in in contact with the second liquid delivery element 320. Also, the second liquid delivery element 320 may be in contact with the atomizer 400.

That is, the atomizer 400, the second liquid delivery element 320, and the first liquid delivery element 310 may be sequentially arranged in the longitudinal direction (for example, the +z direction) of the cartridge 10 or the housing 100, and as a result, the second liquid delivery element 320 and the first liquid delivery element 310 may be sequentially stacked on the atomizer 400.

At least a part of an aerosol generating material supplied from the reservoir 200 to the first liquid delivery element 310 may be moved to the second liquid delivery element 320 in contact with the first liquid delivery element 310. In addition, the aerosol generating material moved to the second liquid delivery element 320 may reach the atomizer 400 in contact with the second liquid delivery element 320.

The drawings illustrate only an embodiment in which the liquid delivery element 300 includes two liquid delivery element, but the liquid delivery element 300 may also include one or three or more liquid delivery elements depending on embodiments.

According to one embodiment, the atomizer 400 may generate an aerosol by atomizing the aerosol generating material supplied from the liquid delivery element 300.

For example, the atomizer 400 may include a vibrator that generates ultrasonic vibrations. A frequency of the ultrasonic vibrations generated by the vibrator may be about 100 kHz to about 10 MHz, and preferably about 100 kHz to about 3.5 MHz. The vibrator may vibrate in a longitudinal direction (or an "up-down direction") of the cartridge 10 or the housing 100 according to the frequency described above.

The aerosol generated by the atomizer 400 according to an ultrasonic method may have a relatively low temperature compared to an aerosol generated by heating an aerosol generating material. In a heating method where an aerosol generating material is heated by using a heater, an aerosol generating material may be unintentionally heated to a temperature of 200° C. or higher, and thus a user may feel a burnt taste in the aerosol.

On the other hand, the cartridge 10 according to one embodiment may generate an aerosol in a temperature range of about 100° C. to about 160° C. by an ultrasonic method, which is lower than in the heating method. Accordingly, the cartridge 10 may reduce a burnt taste in an aerosol.

According to one embodiment, air outside the cartridge 10 (hereinafter, referred to as "external air") may be introduced into the cartridge 10 through an air inlet **130*i* formed in the housing 100**.

An aerosol introduced into the housing 100 through the air inlet **130*i* may flow along the air inlet passage (see 130 in FIG. 8) that provides fluid communication between the air inlet 130*i* and the atomizer 400, and reach the atomizer 400. The external air reaching the atomizer 400 may be mixed with vaporized particles generated by the atomizer 400** to generate an aerosol.

The aerosol generated by mixing the external air with the particles generated by the atomizer 400 may flow along an outlet passage (for example, the outlet passage 150 in FIG. 2) to be discharged to the outside of the cartridge 10 through the outlet **160*e* of the mouthpiece 160**, thereby being supplied to a user. Detailed description on a flow direction of the aerosol will be provided below.

The cartridge 10 according to one embodiment may further include a structure 140 for preventing droplets splattering from the atomizer 400 from being supplied to a user, and a first support member 141 for fixing or supporting the structure 140.

While an aerosol generating material is atomized by ultrasonic vibrations generated by the atomizer 400, a portion of the aerosol generating material may not be atomized and thus droplets may be generated. The generated droplets may splatter by the ultrasonic vibrations generated by the atomizer 400 and may be discharged to the outside of the cartridge 10 through the outlet **160*e*. In this regard, the structure 140 may be at a position adjacent to the outlet passage 150 to restrict movement or flow of the bounced droplets in a direction toward the outlet 160*e* of the mouthpiece 160**.

For example, the structure 140 may include a material (for example, a felt material) capable of absorbing droplets splattering from the atomizer 400, thereby restricting movement or flow of the droplets toward the outlet **160*e***, but it is not limited thereto.

When the droplets splattering from the atomizer 400 are discharged to the outside of the cartridge 10 through the outlet **160*e*** and delivered to a user, the user may feel uncomfortable, and thus a smoking sensation of the user may get worse. In the present disclosure, the "smoking sensation" may indicate a sense that a user feels during smoking.

The cartridge 10 according to one embodiment may restrict movement of the droplets splattering from the atomizer 400 without being atomized through the structure 140 in a direction toward the outlet **160*e*, and thus a user's smoking sensation may not be deteriorated by the droplet splatter. In the present disclosure, the "droplet splatter" may refer to a phenomenon where droplets that are not atomized are splashed by the vibrations generated by the atomizer 400** and delivered to a user.

The first support member 141 may accommodate at least one region of the structure 140 and fix the accommodated structure 140 in the first housing 110. For example, the first support member 141 may hold or fix the structure 140 to one region (for example, an upper region) adjacent to the mouthpiece 160 of the first housing 110 but is not limited thereto.

In one embodiment, the first support member 141 may be arranged to surround at least one region of the structure 140, and as the first support member 141 accommodating the structure 140 is coupled to one region of the first housing 110, the structure 140 may be fixed to the one region of the first housing 110.

The first support member 141 accommodating the structure 140 may be coupled to the first housing 110 in such a way that at least a part of the first support member 141 is press-fitted to the first housing 110. However, the coupling method of the first housing 110 and the first support member 141 is not limited to the example described above. In another example, the first housing 110 may be coupled to the first support member 141 by using at least one of a snap-fit method, a screw coupling method, and a magnetic coupling method.

The first support member 141 may include a material (for example, rubber) with rigidity and a waterproof property to not only fix the structure 140 to the first housing 110 but also prevent an aerosol generating material generated in the reservoir 200 from leaking. For example, the first support member 141 may prevent the aerosol generating material from leaking by blocking a region of the reservoir 200 facing the mouthpiece 160.

The cartridge 10 according to one embodiment may further include a second support member 340 for holding the liquid delivery element 300 and/or the atomizer 400 inside the first housing 110.

The second support member 340 may accommodate the first liquid delivery element 310, the second liquid delivery element 320, and/or the atomizer 400. The second support member 340 accommodating the first liquid delivery element 310, the second liquid delivery element 320, and/or the atomizer 400 may be coupled to the first housing 110, and thus the first liquid delivery element 310, the second liquid delivery element 320, and/or the atomizer 400 may be fixed to the first housing 110.

For example, the second support member 340 may be coupled to a region (for example, a lower region) of the first housing 110 which is opposite to another region of the first housing 110 which is coupled to the first support member 141, but it is not limited thereto.

The second support member 340 may be coupled to the first housing 110 in such a way that at least a part of the second support member 340 is press-fitted to the first housing 110, but the coupling method of the first housing 110 and the second support member 340 is not limited to the example described above. In another example, the first housing 110 may also be coupled to the second support member 340 by using at least one of a snap-fit method, a screw coupling method, and a magnetic coupling method.

The second support member 340 may include a material (for example, rubber) with rigidity and a waterproof property to not only fix the liquid delivery element 300 and the atomizer 400 to the first housing 110 but also prevent an aerosol generating material generated in the reservoir 200 from leaking. For example, the second support member 340 may prevent an aerosol generating material from leaking by blocking a region of the reservoir 200 adjacent to the liquid delivery element 300 or the atomizer 400.

TABLE 1

| specification | | #1 | #2 | #3 | #4 | #5 |
|---|---|---|---|---|---|---|
| weight change | before evaluation | 9.458 (g) | 9.545 (g) | 9.384 (g) | 9.371 (g) | 9.420 (g) |
| | after evaluation | 9.758 (g) | 9.904 (g) | 9.698 (g) | 9.683 (g) | 9.738 (g) |
| | amount of change | +0.300 (g) | +0.359 (g) | +0.314 (g) | +0.312 (g) | +0.318 (g) |

Table 1 illustrates results of an experiment for comparing an initial weight (before evaluation) of the cartridge 10 according to one embodiment with a weight (after evaluation) of the cartridge 10 measured after the cartridge 10 has been stored for 96 hours in the environment with a temperature of about 60° C. and a humidity of about 80% and then for another two hours at room temperature. If an aerosol generating material leaks out of the cartridge 10, the weight of the cartridge 10 decreases over time.

However, as shown in Table 1, the weight of the cartridge 10 according to an embodiment has increased by an average of about 0.321 g compared to the weight before evaluation. Therefore, it can be seen that leakage does not occur in the cartridge 10 according to one embodiment.

Here, the reason that the weight of the cartridge 10 has increased may be due to moisture generated when the environment changed to room temperature after the cartridge 10 is stored at a relatively high humidity (80%).

That is, the cartridge 10 according to one embodiment may prevent an aerosol generating material in the reservoir 200 from leaking through the first support member 141 and/or the second support member 340 described above, and thus failure or an abnormal operation of the cartridge 10 due to leakage may be reduced.

Hereinafter, a coupling method of constituent elements of the cartridge 10 will be described with reference to FIGS. 5A to 5D.

FIGS. 5A to 5D are views illustrating a process of coupling constituent elements of the cartridge 10 in FIG. 3.

Figure 5A:
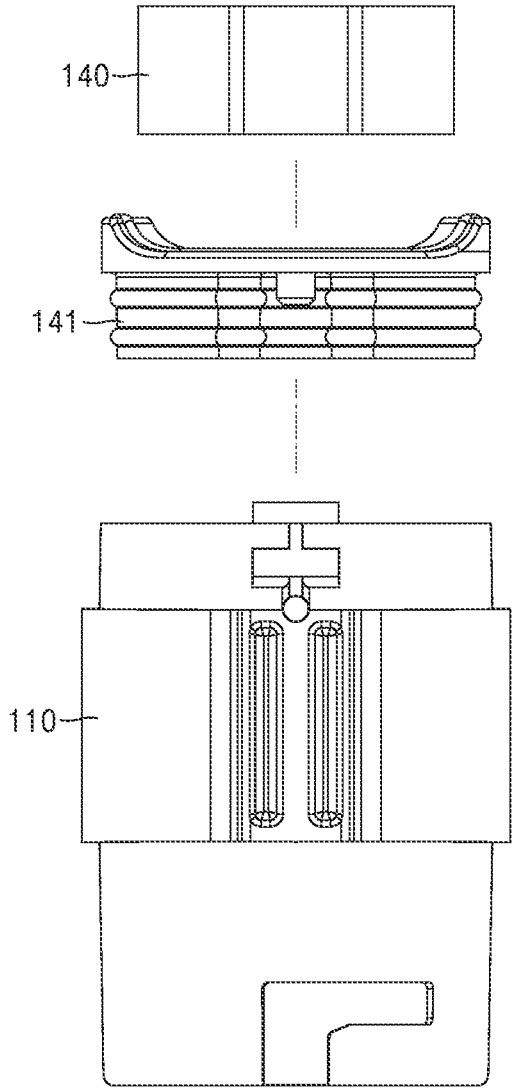
FIGS. 5A and 5B are views illustrating a process of coupling a structure, a first support member and a first housing of the cartridge illustrated in FIG. 4.
Figure 5B:
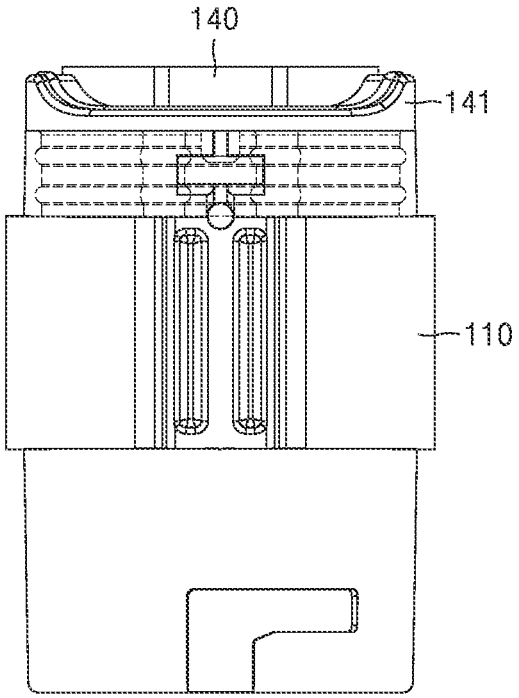
Figure 5C:
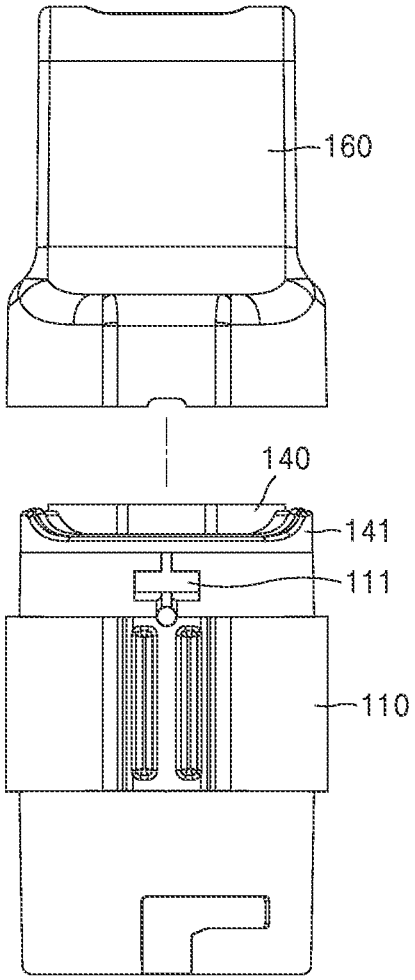
FIGS. 5C and 5D are views illustrating a process of coupling a first housing and a mouthpiece of the cartridge illustrated in FIG. 4.
Figure 5D:
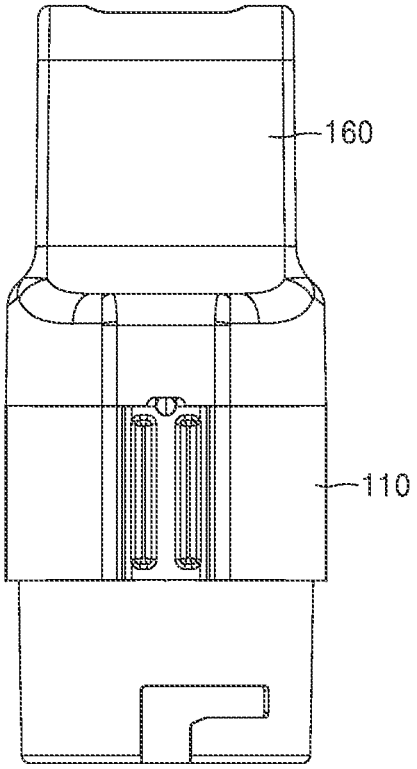

Specifically, FIGS. 5A and 5B are views illustrating a process of coupling a structure 140, a first support member 141, and a first housing 110 of the cartridge 10 illustrated in FIG. 4. FIGS. 5C and 5D illustrate a process of coupling a first housing 110 and a mouthpiece 160 of the cartridge 10 illustrated in FIG. 4.

Figure 5E:
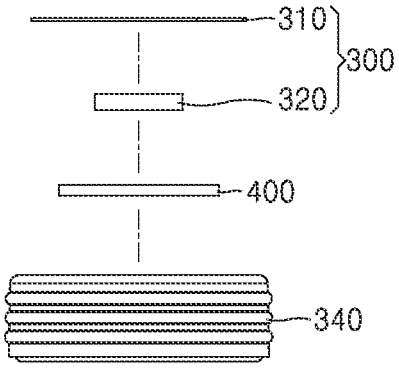
FIGS. 5E, 5F, and 5G are views illustrating a process of coupling a first housing, a plurality of liquid delivery elements, an atomizer, and a second support member of the cartridge illustrated in FIG. 4.
Figure 5F:
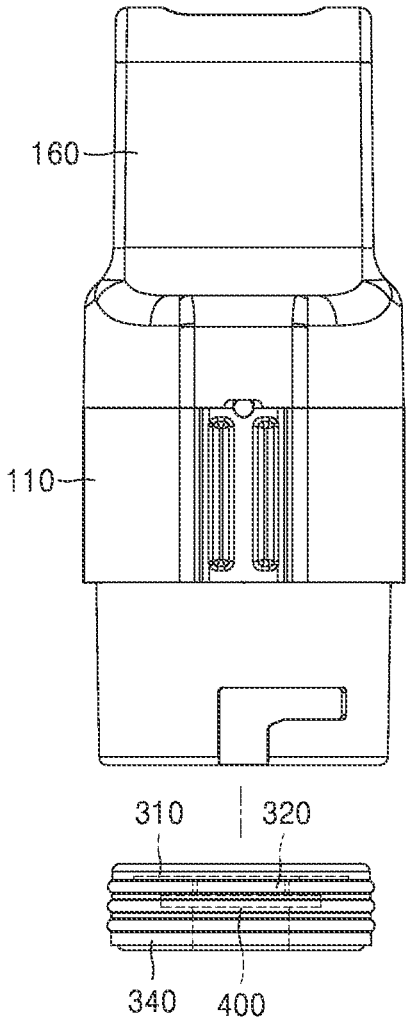
Figure 5G:
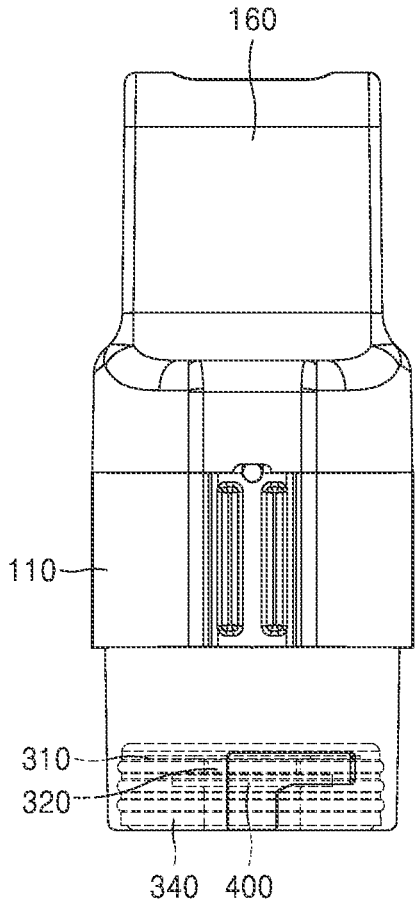
Figure 5H:
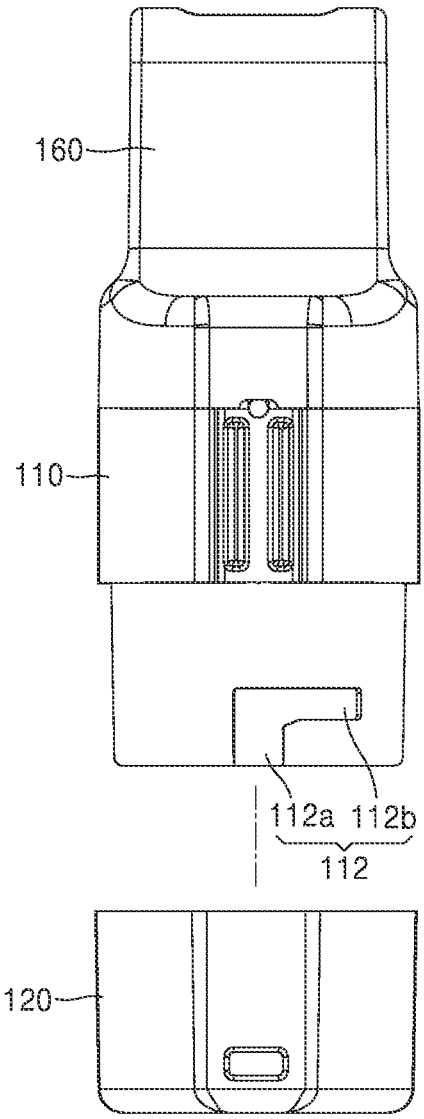
FIGS. 5H and 5I are views illustrating a process of coupling a first housing and a second housing of the cartridge illustrated in FIG. 4.
Figure 5I:
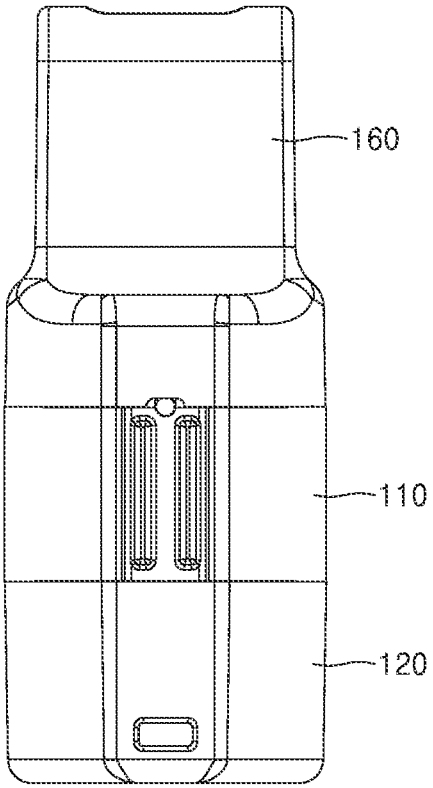

FIGS. 5E, 5F, and 5G are views illustrating a process of coupling the first housing 110, a plurality of liquid delivery elements 300, an atomizer 400, and a second support member 340 of the cartridge 10 illustrated in FIG. 4. FIGS. 5H and 5I are views illustrating a process of coupling the first housing 110 and the second housing 120 of the cartridge 10 illustrated in FIG. 4.

Referring to FIGS. 5A and 5B, the structure 140 and the first support member 141 may be coupled to one region of the first housing 110.

The first support member 141 may accommodate the structure 140 by surrounding at least a part of an outer circumferential surface of the structure 140. The first support member 141 accommodating the structure 140 may be coupled to one region (for example, an upper region) of the first housing 110, and thus the structure 140 may be fixed to the first housing 110.

The first support member 141 may be coupled to the first housing 110 in such a way that at least a part of the first support member 141 is press-fitted to an inner space of the first housing 110, but it is limited thereto. Although not illustrated in the drawings, the first support member 141 may be coupled to the first housing 110 by using at least one of a snap-fit method, a screw coupling method, and a magnetic coupling method.

Referring to FIGS. 5C and 5D, the mouthpiece 160 may be coupled to the first housing 110. In one embodiment, the mouthpiece 160 may be coupled to a region of the first housing 110 which is adjacent to the structure 140 and the first support member 141. For example, the mouthpiece 160 may be coupled to an upper region of the first housing 110.

According to one embodiment, at least a part of the first housing 110 may be inserted into the mouthpiece 160 such that the mouthpiece 160 surrounds a part of an outer circumferential surface of the housing 110, but the coupling method of the first housing 110 and the mouthpiece 160 is not limited thereto.

In another embodiment, a first groove 111 is formed in one region of the first housing 110, and at least one protrusion (or a "hook") (not illustrated) protruding from an inner wall of the mouthpiece 160 may be formed in the mouthpiece 160. When at least a part of the first housing 110 is inserted into the mouthpiece 160, at least one protrusion of the mouthpiece 160 may be inserted into the first groove 111 of the first housing 110, and thus the mouthpiece 160 may be coupled to the first housing 110.

Referring to FIGS. 5E, 5F, and 5G, the liquid delivery element 300, the atomizer 400, and the second support member 340 may be coupled to the first housing 110. For example, the liquid delivery element 300, the atomizer 400, and the second support member 340 may be coupled to a region of the first housing 110 which is opposite to another region where the structure 140 and the first support member 141 are coupled to the first housing 110.

The second support member 340 may surround at least a part of outer circumferential surfaces of the first liquid delivery element 310, the second liquid delivery element 320 and the atomizer 400 such that the liquid delivery element 310, the second liquid delivery element 320, and the atomizer 400 are accommodated in the second support member 340.

The second support member 340 accommodating the first liquid delivery element 310, the second liquid delivery element 320, and the atomizer 400 may be coupled to a region (for example, a lower region) of the first housing 110, and thus the first liquid delivery element 310, the second liquid delivery element 320, and the atomizer 400 may be fixed to the first housing 110.

The second support member 340 may be coupled to the first housing 110 in such a way that at least a part of the second support member 340 is press-fitted to an inner space of the first housing 110, but the present disclosure is limited thereto. Although not illustrated in the drawings, the second support member 340 may be coupled to the first housing 110 by using at least one of a snap-fit method, a screw coupling method, and a magnetic coupling method.

Referring to FIGS. 5H and 5I, the second housing 120 may be coupled to the first housing 110. In one embodiment, the second housing 120 may be coupled to a region of the first housing 110 which is adjacent to another region where the liquid delivery element 300, the atomizer 400, and/or the second support member 340 are coupled to the first housing 110. For example, the second housing 120 may be coupled to a lower region of the first housing 110.

According to one embodiment, at least a part of the first housing 110 may be inserted into the second housing 120 such that the second housing 120 surrounds a part of an outer circumferential surface of the first housing 110, but the coupling method of the first housing 110 and the second housing 120 is not limited thereto.

In another embodiment, a second groove 112 may be formed in the first housing 110, and at least one protrusion (not illustrated) protruding from an inner wall of the second housing 120 may be formed in the second housing 120. When at least a part of the first housing 110 is inserted into the second housing 120, at least one protrusion of the second housing 120 may be inserted into the second groove 112 of the first housing 110, and thus the second housing 120 may be coupled to the first housing 110.

For example, the second groove 112 may include a first portion 112*a* formed in a longitudinal direction of the first housing 110 and a second portion 112*b* transverse to the first portion 112*a*. The second portion 112*b* may be formed to extend from an upper end of the first portion 112*a* in a horizontal direction substantially perpendicular to the longitudinal direction of the first housing 110, but it is limited thereto.

In the process of coupling the first housing 110 and the second housing 120, at least one protrusion of the second housing 120 may be first inserted into the first portion 112*a* of the second groove 112. In a state in which at least one protrusion of the second housing 120 is inserted into the first portion 112*a* of the second groove 112, when the second housing 120 rotates around the first housing 110 clockwise or counterclockwise, at least one protrusion may move from the first portion 112*a* to the second portion 112*b*, and thus the first housing 110 may be coupled to the second housing 120.

The second housing 120 coupled to the first housing 110 may surround the liquid delivery element 300, the atomizer 400, and/or the second support member 340 coupled to the first housing 110 such that the liquid delivery element 300, the atomizer 400, and/or the second support member 340 are not exposed to the outside of the cartridge 10.

With the arrangement structure described above, the liquid delivery element 300, the atomizer 400, and/or the second support member 340 may be protected from external impact or foreign materials from the outside by the first housing 110 and the second housing 120.

Hereinafter, a process of generating and discharging an aerosol will be described in detail with reference to FIGS. 6 to 8.

Figure 6:
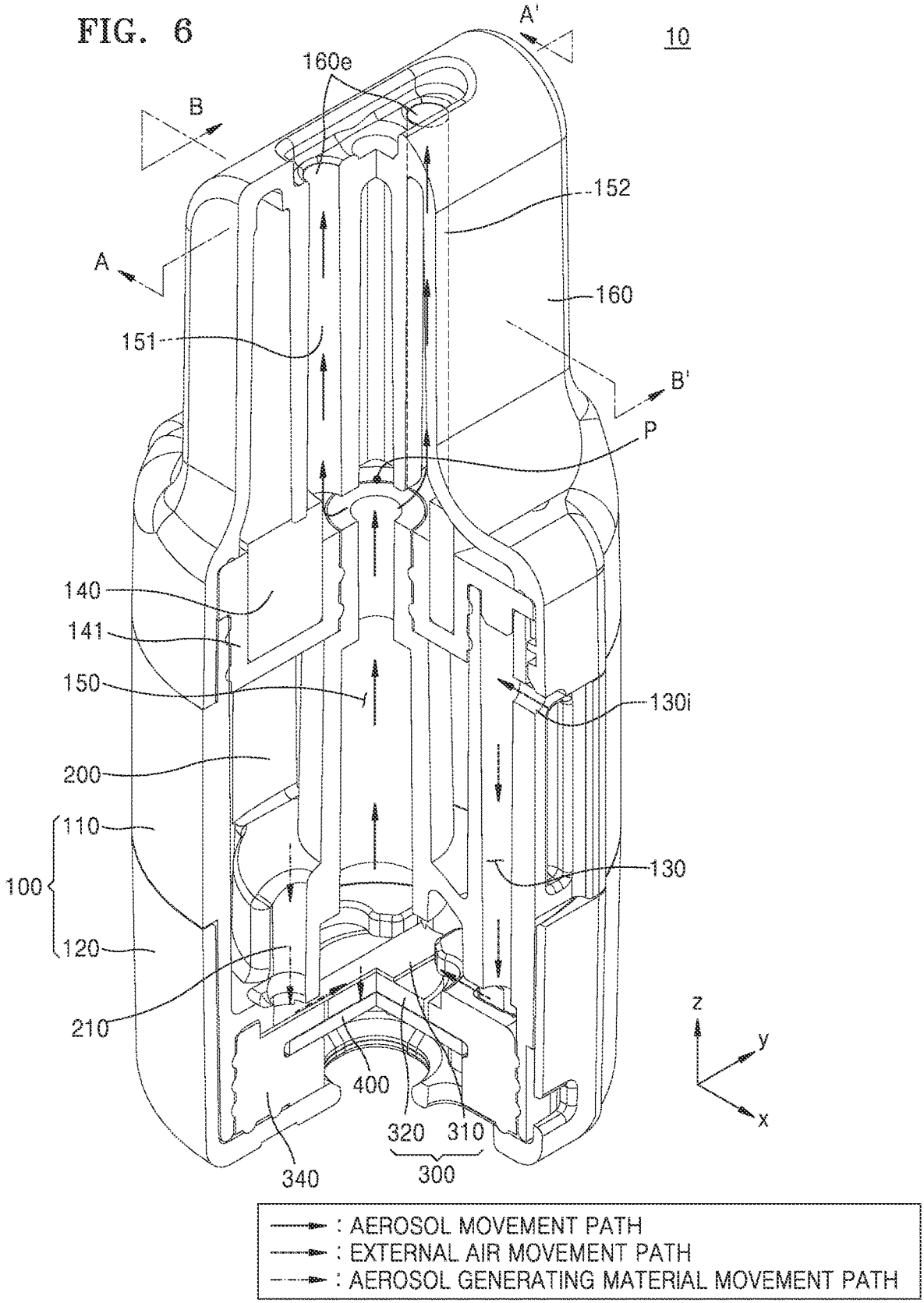
FIG. 6 is a perspective view illustrating the inside of a partial region of a cartridge according to an embodiment.
Figure 7:
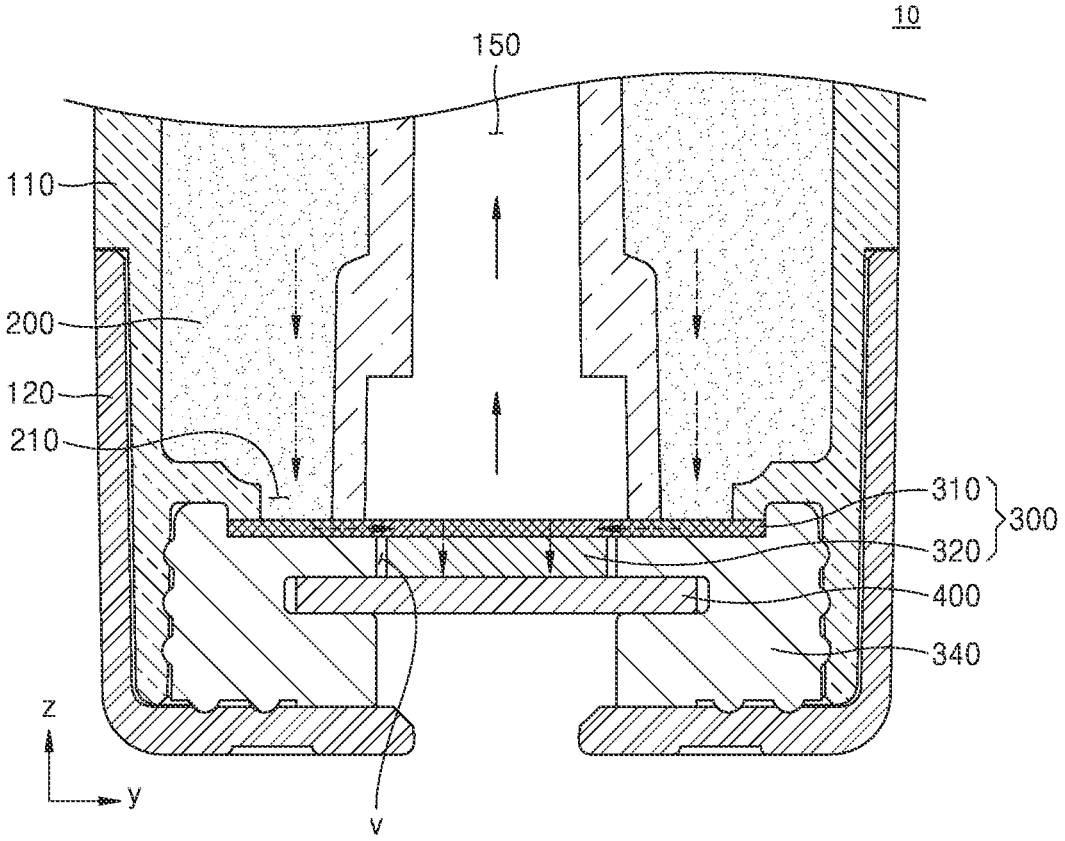
FIG. 7 is a cross-sectional view of the cartridge illustrated in FIG. 6 taken along a direction A-A'.
Figure 8:
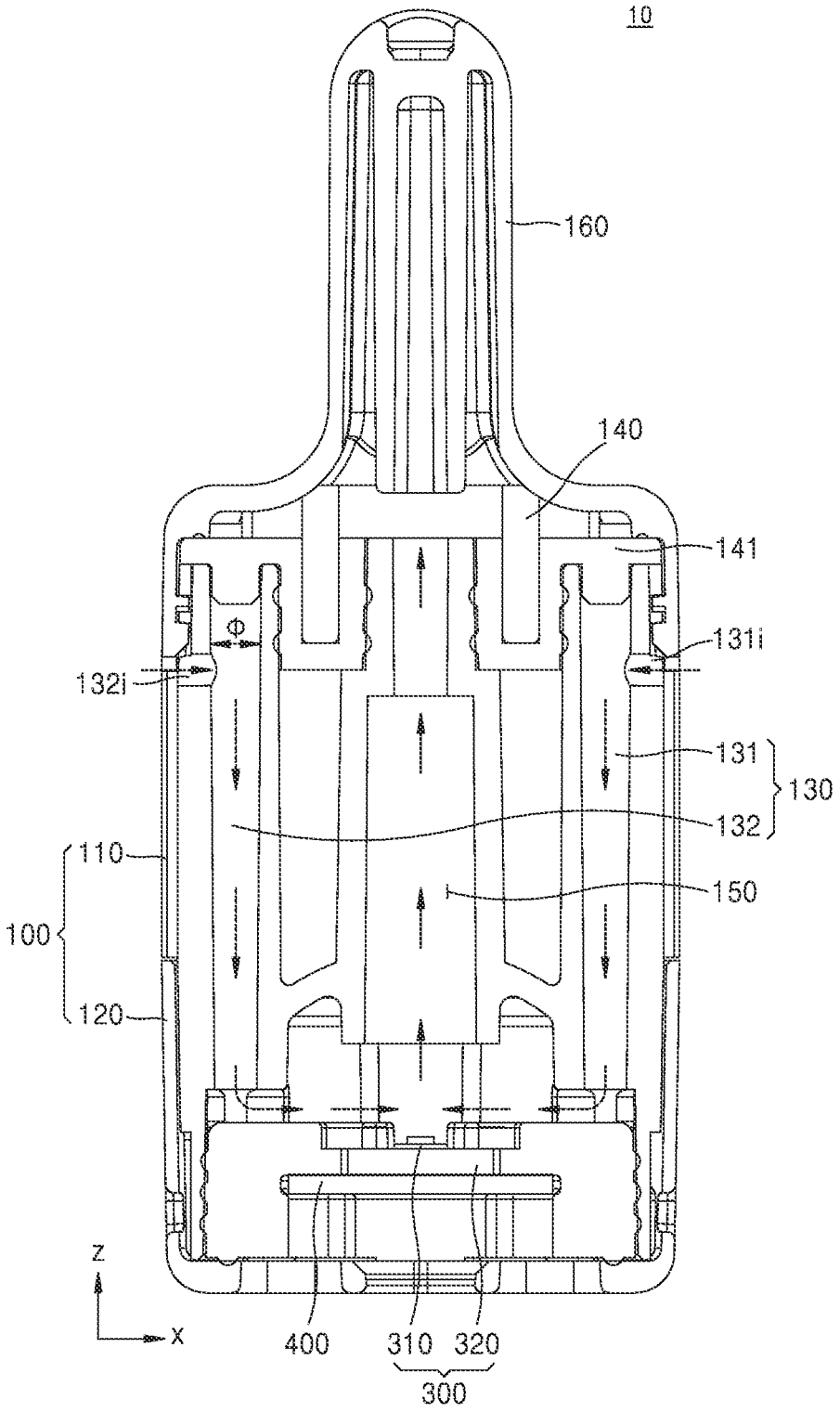
FIG. 8 is a cross-sectional view of the cartridge illustrated in FIG. 6 taken along a direction B-B'.

FIG. 6 is a perspective view illustrating the inside of a partial region of a cartridge according to an embodiment, FIG. 7 is a cross-sectional view of the cartridge illustrated in FIG. 6 taken along direction A-A', and FIG. 8 is a cross-sectional view of the cartridge illustrated in FIG. 6 taken along direction B-B'.

In FIGS. 6-8, alternate long and short dash lines indicate movement paths of aerosol generating materials, dashed lines indicate movement paths of external air, and solid lines indicate movement paths of an aerosol.

A cartridge 10 according to one embodiment may include a housing 100, an air inlet passage 130, a structure 140, a first support member 141, an outlet passage 150, a mouthpiece 160, a reservoir 200, a first liquid delivery element 310, a second liquid delivery element 320, a second support member 340, and an atomizer 400.

Some constituent elements of the cartridge 10 shown in FIGS. 6-8 have been described above with reference to FIGS. 3 and 4, and thus redundant descriptions thereof are omitted hereinafter.

Referring to FIGS. 6 and 7, the liquid delivery element 300 may deliver a liquid aerosol generating material stored in the reservoir 200 to the atomizer 400, and the atomizer 400 may atomize the aerosol generating material delivered from the liquid delivery element 300 into small particles.

The aerosol generating material stored in the reservoir 200 may be supplied to the liquid delivery element 300 through a connection passage 210 that provides fluid communication between the inner space of the reservoir 200 and the liquid delivery element 300.

The liquid delivery element 300 may be disposed in a lower end (for example, the end portion in the −z direction of FIGS. 6 and 7) of the reservoir 200, and the aerosol generating material stored in the reservoir 200 may be moved by gravity in a downward direction (for example, the −z direction of FIGS. 6 and 7) toward the liquid delivery element 300 along the connection passage 210. In the present disclosure, the "−z direction" may indicate a direction of the gravity.

In one embodiment, the aerosol generating material stored in the reservoir 200 may be moved along the connection passage 210 to reach the first liquid delivery element 310, and the first liquid delivery element 310 may absorb the aerosol generating material.

In one example, the first liquid delivery element 310 may extend in a direction transverse to the longitudinal direction (for example, the z-axis direction) of the housing 100. For example, the first liquid delivery element 310 may extend in the horizontal direction (for example, the y-axis direction) substantially perpendicular to the longitudinal direction of the housing 100, but it is not limited thereto.

The region of the first liquid delivery element 310 adjacent to the connection passage 210 of the reservoir 200 may have a larger area than other regions of the first liquid delivery element 310. For example, both end portions of the first liquid delivery element 310 may be formed to have a larger area than other regions of the first liquid delivery element 310, but embodiments are not limited thereto.

As the region of the first liquid delivery element 310 adjacent to the connection passage 210 is formed to have a larger area than other regions of the first liquid delivery element 310, the first liquid delivery element 310 may absorb the aerosol generating material through a large area. As a result, the amount of an aerosol generating material absorbed by the first liquid delivery element 310 may be increased, and thus the amount of an aerosol generating material delivered to the atomizer 400 may be increased.

The aerosol generating material absorbed by the first liquid delivery element 300 may be moved in the horizontal direction (for example, the y-axis direction) along the first liquid delivery element 310 and then may be delivered to the second liquid delivery element 320 disposed under the first liquid delivery element 310.

In one embodiment, the second liquid delivery element 320 may be in contact with the first liquid delivery element 310 and the atomizer 400. For example, one surface (for example, a surface facing the +z direction) of the second liquid delivery element 320 facing the first liquid delivery element 310 may be in contact with the first liquid delivery element 310, and the other surface (for example, a surface facing the −z direction) may be in contact with the atomizer 400, but embodiments are not limited thereto.

The second liquid delivery element 320 may be arranged between the first liquid delivery element 310 and the atomizer 400 and may be in contact with the first liquid delivery element 310 and the atomizer 400. Thus, an aerosol generating material absorbed by the first liquid delivery element 310 may be delivered to the atomizer 400.

For example, the aerosol generating material delivered from the first liquid delivery element 310 to the second liquid delivery element 320 may be moved along the second liquid delivery element 320 in the −z direction to reach the atomizer 400.

The second liquid delivery element 320 may be formed in a cylindrical shape having a smaller cross-sectional area than the atomizer 400, but the shape and the size of the second liquid delivery element 320 are not limited thereto. For example, the second liquid delivery element 320 may be formed in a polygonal column shape. Also, the second liquid delivery element 320 may have substantially the same cross-sectional area as the atomizer 400.

The atomizer 400 may vaporize (i.e., atomize) the aerosol generating material delivered through the first liquid delivery element 310 and the second liquid delivery element 320 into small particles. For example, the atomizer 400 may generate ultrasonic vibrations in the +z direction and/or the −z direction, and the aerosol generating material delivered to the atomizer 400 may be atomized by the ultrasonic vibrations.

A part of the aerosol generating material delivered to the atomizer 400 may not be atomized by the ultrasonic vibrations generated by the atomizer 400, and thus a droplet may splatter from the atomizer 400 to a user's mouth, which deteriorate the user's smoking sensation.

However, the cartridge 10 according to one embodiment restricts the splatter of droplets by using the first liquid delivery element 310 and/or the second liquid delivery element 320. Thus, a user's smoking sensation may not be deteriorated due to the droplets.

In one embodiment, the first liquid delivery element 310 and/or the second liquid delivery element 320 may block the droplets splattering toward the outside of the cartridge 10. To this end, the first liquid delivery element 310 and the second liquid delivery element 320 may be disposed between the atomizer 400 and the outlet passage 150.

In one embodiment, the first liquid delivery element 310 may be formed in a shape extending longer in the horizontal direction (for example, the y-axis direction) than the second liquid delivery element 320.

A free space v may be formed between the second liquid delivery element 320 and the second support member 340 accommodating the second liquid delivery element 320, and the droplet may splatter in the free space v.

In the cartridge 10 according to an embodiment, the first liquid delivery element 310 may be longer than the second liquid delivery element 320 in the horizontal direction, and thus the first liquid delivery element 310 may extend beyond the second liquid delivery element 320.

Due to the above-described arrangement structure, the first liquid delivery element 310 may cover at least a part of the free space v between the second liquid delivery element 320 and the second support member 340, and thus the first liquid delivery element 310 may prevent the droplets in the free space v splattering toward the outlet passage 150.

Referring to FIGS. 6 and 8, the external air may be introduced into the cartridge 10 through at least one air inlet passage 130 formed in the housing 100. For example, the external air may be introduced into the cartridge 10 through the air inlet 130*i* formed on an outer circumferential surface of the housing 100.

At least one air inlet passage 130 may provide fluid communication between the atomizer 400 and the outside of the cartridge 10. Accordingly, the external air may move to the atomizer 400 in the cartridge 10 through at least one air inlet passage 130. The external air moved to the atomizer 400 may be mixed with vaporized particles generated by the atomizer 400, and thus an aerosol may be generated.

In one embodiment, at least one air inlet passage 130 may be arranged adjacent to the reservoir 200 in the first housing 110, but an arrangement structure of at least one air inlet passage 130 and the reservoir 200 is not limited to the embodiment described above.

According to one embodiment, at least one air inlet passage 130 may include a first air inlet passage 131 and a second air inlet passage 132.

The first air inlet passage 131 may be spaced apart from the second air inlet passage 132 in the first housing 110. For example, the first air inlet passage 131 may be on the right side of an inner space of the first housing 110, and the second air inlet passage 132 may be on the left side of the inner space of the first housing 110.

As shown in FIG. 8, the external air may be introduced into the cartridge 10 through the first air inlet 131*i* of the first air inlet passage 131, and then move in a direction toward the atomizer 400 along the first air inlet passage 131. Also, the external air may be introduced into the cartridge 10 through the second air inlet 132*i* of the second air inlet passage 132, and then move in a direction toward the atomizer 400 along the second air inlet passage 132.

External air moved to the atomizer 400 through the first air inlet passage 131 and/or the second air inlet passage 132 may be mixed with vaporized particles generated by the atomizer 400 to generate an aerosol.

TABLE 2

| specification | Diameter of air inlet passage | Sum of cross-sectional areas of air inlet passages | Draw resistance |
|---|---|---|---|
| #1 | 1.0 (mm) | About 1.6 (mm2) | 64.5 mm H2O |
| #2 | 1.2 (mm) | About 2.3 (mm2) | 35.2 mm H2O |
| #3 | 1.3 (mm) | About 2.7 (mm2) | 31.6 mm H2O |

Table 2 illustrates the sum of cross-sectional areas of air inlet passages and the draw resistance, according to different diameters T of the first air inlet passage 131 and the second air inlet passage 132. The draw resistance of the aerosol may be changed according to a proportion of external air contained in the aerosol. As shown above, if the cartridge 10 according to one embodiment includes the first air inlet passage 131 and/or the second air inlet passage 132 having the diameter T of about 1.0 mm to about 1.3 mm, the draw resistance of the aerosol may be maintained in the range of about 30 mmH2O to about 70 mmH2O.

When the draw resistance of an aerosol is less than 30 mmH2O, a user may not feel inhalation of the aerosol. On the other hand, when the draw resistance of the aerosol is greater than 70 mmH2O, the user may feel difficult to inhale the aerosol due to the large draw resistance.

The cartridge 10 according to one embodiment maintains the draw resistance at about 30 mmH2O to about 70 mmH2O through the first air inlet passage 131 and the second air inlet passage 132, and thus a user's smoking sensation may be improved.

An aerosol generated by mixing external air with vaporized particles generated by the atomizer 400 may be discharged to the outside of the cartridge 10 through the outlet passage 150 to be supplied to a user.

According to one embodiment, the outlet passage 150 may provide fluid communication between the atomizer 400 and the outlet 160*e* of the mouthpiece 160. Accordingly, the aerosol may move or flow along the outlet passage 150, and then may be discharged to the outside of the cartridge 10 through the outlet 160*e*.

In one embodiment, at least a part of an outer circumferential surface of the outlet passage 150 may be arranged to be surrounded by the reservoir 200, but an arrangement structure of the outlet passage 150 and the reservoir 200 is not limited to the embodiment described above.

In one embodiment, the outlet passage 150 may branch into a first outlet passage 151 and a second outlet passage 152.

The outlet passage 150 may branch at the region P of the outlet passage 150 which is adjacent to the mouthpiece 160. The aerosol reached the one region P of the outlet passage 150 may move to the first outlet passage 151 and/or the second outlet passage 152 and then may be discharged to the outside of the cartridge 10 through the outlet 160*e*.

Although the first liquid delivery element 310 and the second liquid delivery element 320 are arranged on the atomizer 400, droplets splattering from the atomizer 400 may be introduced into the outlet passage 150 and may be discharged to the outside of the cartridge 10.

In the cartridge 10 according to one embodiment, the outlet passage 150 may branch to the first outlet passage 151 and the second outlet passage 152 at the region P adjacent to the mouthpiece 160, and thus droplets splattering from the atomizer 400 may be blocked from being discharged to the outside of the cartridge 10.

For example, droplets introduced into the outlet passage 150 may collide with the ceiling at the region P and then may be absorbed by the structure 140 adjacent to the region P. Thus, the droplets may not be discharged to the outside of the cartridge 10.

That is, the cartridge 10 according to one embodiment may primarily block the droplets from being delivered to a user by using the first liquid delivery element 310 and the second liquid delivery element 320, and may secondarily block the droplets that are not blocked by the first liquid delivery element 310 and/or the second liquid delivery element 320 by using the branched structure of the outlet passage 150 and the structure 140.

Figure 9:
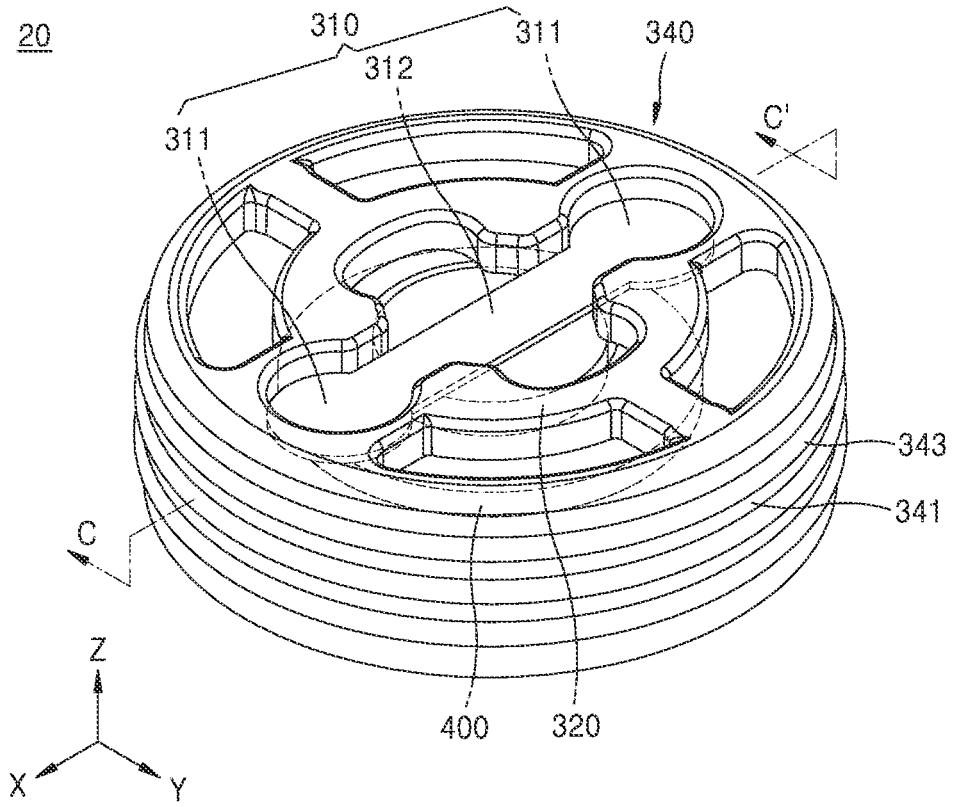
FIG. 9 is a schematic perspective view of an atomization assembly for an aerosol generating device according to an embodiment.
Figure 10:
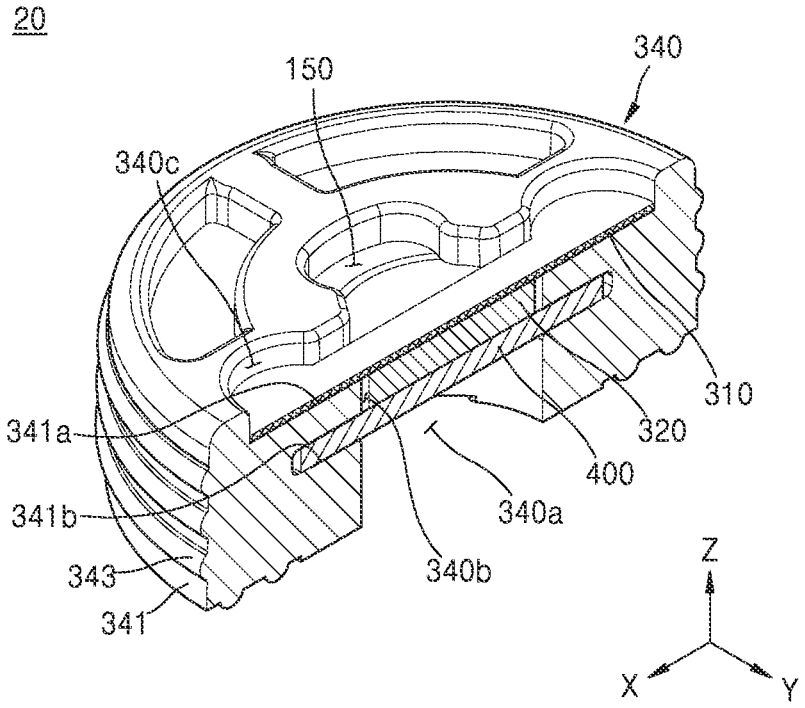
FIG. 10 is a cross-sectional view of the atomization assembly for an aerosol generating device in FIG. 9 taken along a direction C-C.
Figure 11:
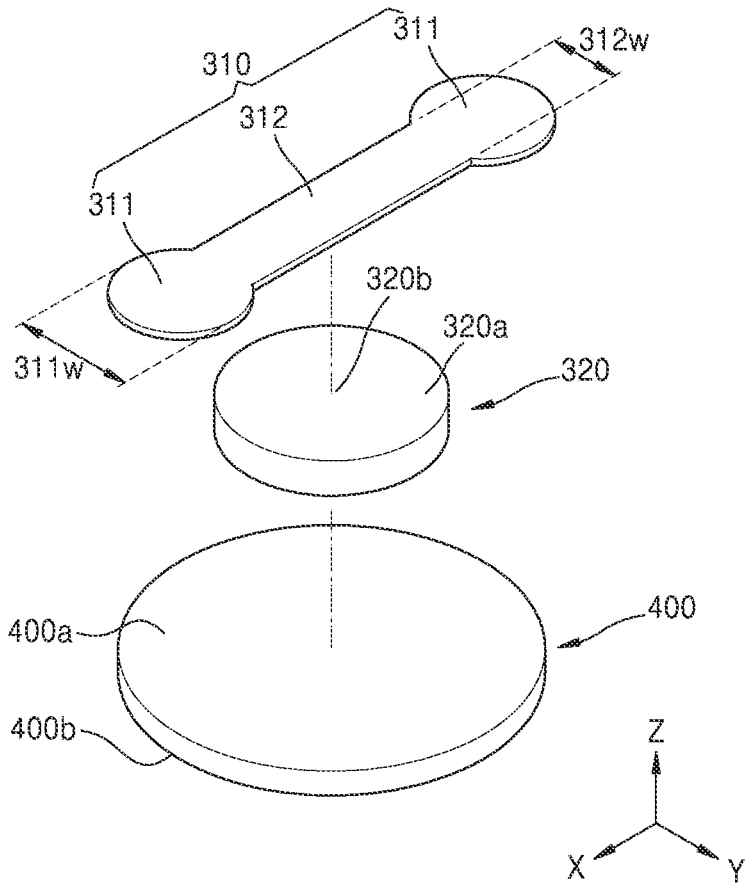
FIG. 11 is an exploded perspective view of some constituent elements of the atomization assembly for an aerosol generating device in FIG. 9.

FIG. 9 is a schematic perspective view of an atomization assembly according to one embodiment, FIG. 10 is a cross-sectional view of the atomization assembly in FIG. 9 taken along direction C-C', and FIG. 11 is an exploded perspective view of partial constituent elements of the atomization assembly in FIG. 9.

Referring to FIGS. 9, 10, and 11, an atomization assembly 20 according to one embodiment generates an aerosol by atomizing an aerosol generating material stored in a reservoir (for example, the reservoir 200 of FIGS. 5 and 6). The atomization assembly 20 according to one embodiment may be included in the aerosol generating device 1000 of FIGS.

1 and 2 and/or in the cartridge 10 of FIGS. 3 to 4 and FIGS. 6 to 8, and thus redundant descriptions thereof are omitted hereinafter.

The atomization assembly 20 according to one embodiment includes an atomizer 400 that atomizes an aerosol generating material to generate an aerosol, a first liquid delivery element 310 that is connected to (i.e., in direct contact with or in fluid communication with) a reservoir to absorb the aerosol generating material, and a second liquid delivery element 320 that is located between the first liquid delivery element 310 and the atomizer 400 to deliver the aerosol generating material absorbed by the first liquid delivery element 310 to the atomizer 400.

An aerosol generating device (for example, the aerosol generating device 1000 of FIGS. 1 and 2) including the atomization assembly 20 described above has the following features and advantages.

First, the second liquid delivery element 320 may cover the atomizer 400, thereby functioning as a physical barrier that prevents particles that are not yet vaporized from being directly inhaled into a user's oral cavity. Therefore, the atomization assembly 20 according to one embodiment may improve the taste of the aerosol.

Second, the atomization assembly 20 according to one embodiment may smoothly transfer an aerosol generating material stored in a reservoir to the atomizer 400 by the arrangement of the first liquid delivery element 310 and the second liquid delivery element 320. Therefore, the atomization assembly 20 according to an embodiment may increase an atomization rate at which an aerosol is generated.

Hereinafter, the atomizer 400, the first liquid delivery element 310, and the second liquid delivery element 320 will be described in detail with reference to the accompanying drawings.

The atomizer 400 functions to generate an aerosol by converting a phase of an aerosol generating material. The atomizer 400 may be arranged inside a housing (for example, the housing 100 of FIG. 4).

In one example, the atomizer 400 may generate an aerosol from an aerosol generating material by using an ultrasonic vibration method. The ultrasonic vibration method may indicate a method of generating an aerosol by atomizing an aerosol generating material with ultrasonic vibrations generated by a vibrator.

In another example, atomizer 400 may also include a heating element for atomizing an aerosol generating material. In this case, the atomizer 400 may include a flat-shaped heating element.

The atomizer 400 may include a heater capable of heating an aerosol generating material by generating heat. The heater may include an electrically conductive track and may be heated as a current flows through the electrically conductive track. However, the heater is not limited to the example described above, and any heater may be used without limitation as long as the heater may be heated to a desirable temperature. An aerosol generating material absorbed by a liquid delivery element may be heated by the heater to generate an aerosol.

The heater may be formed of any suitable electrically resistive material. For example, the suitable electrically resistive material may include a metal such as titanium, zirconium, tantalum, platinum, nickel, cobalt, chromium, hafnium, niobium, molybdenum, tungsten, tin, gallium, manganese, iron, copper, stainless steel, or nichrome, or a metal alloy thereof, but is not limited thereto. In addition, the heater may be implemented by a metal heating wire, a metal heating plate on which an electrically conductive track is arranged, a ceramic heating element, or so on but is not limited thereto.

The first liquid delivery element 310 may transfer or deliver the aerosol generating material to the atomizer 400. The first liquid delivery element 310 may be connected to a reservoir to absorb an aerosol generating material. The first liquid delivery element 310 may also be in contact with the second liquid delivery element 320. Accordingly, the first liquid delivery element 310 may transfer or deliver an aerosol generating material stored in a reservoir to the second liquid delivery element 320.

The first liquid delivery element 310 may extend in a second direction (for example, the x-axis direction in FIG. 9) transverse to a first direction (for example, the z-axis direction in FIG. 9) in which the aerosol generated by the atomizer 400 is discharged. In this case, one end and the other end of the first liquid delivery element 310 may be connected to the reservoir. In the present disclosure, the "first direction" may indicate a direction in which the aerosol is discharged and in which an outlet passage (for example, the outlet passage 150 in FIG. 6) extends.

The first liquid delivery element 310 may be formed of a material capable of absorbing an aerosol generating material. The first liquid delivery element 310 may include a wick including at least one of cotton fiber, ceramic fiber, glass fiber, and porous ceramic, but it is not limited thereto. The first liquid delivery element 310 may maintain the aerosol generating material in an optimal state for conversion into an aerosol.

For example, the first liquid delivery element 310 may include at least one material from among SPL 30(H), SPL 50(H)V, NP 100(V8), SPL 60(FC), and melamine. In the present disclosure, "SPL" and "NP" are codes indicating the type of resin.

The first liquid delivery element 310, the second liquid delivery element 320, and the atomizer 400 may be sequentially arranged in a delivery direction of an aerosol generating material. In this case, in the atomization assembly 20 according to one embodiment, an aerosol generating material may be transferred in a gravity direction (for example, the −z direction), and thus the aerosol generating material may be more smoothly transferred to the atomizer 400. A delivery direction of an aerosol generating material may indicate a direction opposite to the first direction in which the aerosol is discharged, and may also indicate a direction toward the atomizer 400 from a mouthpiece (for example, the mouthpiece of FIG. 6).

The first liquid delivery element 310 may have a rectangular parallelepiped shape as a whole, but the shape of the first liquid delivery element 310 is not limited thereto. Although not illustrated in the drawings, the first liquid delivery element 310 may also be formed in other shapes such as a circular ring shape, as long as the first liquid delivery element may transfer an aerosol generating material.

Referring to FIGS. 9 and 11, the first liquid delivery element 310 may include absorbent portions 311 and a delivery portion 312.

The absorbent portions 311 may be a part of the first liquid delivery element 310 that is connected to a reservoir to receive an aerosol generating material. For example, the absorbent portions 311 may be in contact with the reservoir or may be disposed below the reservoir without contact. The absorbent portions 311 may be respectively connected to the reservoir. The absorbent portions 311 may be connected to the delivery portion 312. The absorbent portions 311 may be respectively one end and the other end of the first liquid delivery element 310. A cross-section of the absorbent portion 311 cut in a second direction (for example, the x-axis direction) may have a circular shape as a whole. However, the shape of the absorbent portion 311 is not limited thereto and may have another shape as long as the absorbent portion 311 is able to receive an aerosol generating material.

The delivery portion 312 may be connected to the absorbent portions 311 and the second liquid delivery element 320. The delivery portion 312 may be a part of the first liquid delivery element 310 for delivering an aerosol generating material to the second liquid delivery element 320. To this end, the delivery portion 312 may be in contact with the second liquid delivery element 320. The delivery portion 312 may be integrally formed with the absorbent portions 311. The cross section of the delivery portion 312 cut in the second direction (for example, the x-axis direction) may have a rectangular shape as a whole, but the shape of the delivery portion 312 is not limited thereto. The delivery portion 312 may have another shape as long as the delivery portion 320 may deliver an aerosol generating material to the liquid delivery element 320.

Referring to FIG. 11, a width 312*w* of the delivery portion 312 may be smaller than a width 311*w* of the absorbent portion 311. That is, the absorbent portions 311 may have a greater width than the delivery portion 312. The width 312*w* of the delivery portion 312 and the width 311*w* of the absorbent portion 311 may be measured along a third direction (for example, the y-axis direction) transverse to a first direction (for example, the z-axis direction) and a second direction (for example, the x-axis direction).

In the present disclosure, the first direction, the second direction, and the third direction are not limited to directions orthogonal to each other, such as the z-axis direction, the x-axis direction, and the y-axis direction, and the first to third directions may be directions crossing each other without being orthogonal to each other.

The atomization assembly 20 according to one embodiment may include the absorbent portions 311 having a greater width than the delivery portion 312, thereby increasing an area for absorbing the aerosol generating material. Therefore, an absorption capacity of the first liquid delivery element 310 may be increased.

In addition, the delivery portion 312 has a smaller width than the absorbent portions 311, and thus the atomization assembly 20 according to one embodiment may intensively deliver an aerosol generating material to the second liquid delivery element 320.

The second liquid delivery element 320 may face one side 400*a* of the atomizer 400. In the present disclosure, the expression that a first element "faces" or "is connected to" a second element means that the first element may be in contact with the second element or in fluid communication with the second element without contact. In this light, the second liquid delivery element 320 may be in contact with the atomizer 400 or the surface of the second liquid delivery element 320 may be slightly apart from the surface of the atomizer 400.

In one example, when the surface of the second liquid delivery element 320 is in contact with the surface of the atomizer 400, an aerosol generating material absorbed by the second liquid delivery element 320 may be directly delivered to the atomizer 400.

In another example, when the surface of the second liquid delivery element 320 is spaced apart from the surface of the atomizer 400, the aerosol generating material absorbed by the second liquid delivery element 320 may be delivered to the atomizer 400 after passing through the interval between the second liquid delivery element 320 and the atomizer 400. The second liquid delivery element 320 may face the one side 400*a* of the atomizer 400 such that the second liquid delivery element 320 may cover or screen at least a part of one side 400*a* of the atomizer 400.

Accordingly, the liquid splattering from the atomizer 400 may be blocked by the second liquid delivery element 320 and thus it may not move to an outlet passage.

In one example, the one side 400*a* of the atomizer 400 may face a first direction in which an aerosol is discharged. That is, the one side 400*a* of the atomizer 400 may face the outlet passage 150. In another example, the other side 400*b* of the atomizer 400 may face the opposite direction (for example, the −z direction).

When the second liquid delivery element 320 faces the one side 400*a* of the atomizer 400, at least a part of the first liquid delivery element 310 may overlap the second liquid delivery element. That is, the second liquid delivery element 320 and the first liquid delivery element 310 may be sequentially stacked in the first direction (for example, the z-axis direction), overlapping each other.

Accordingly, the atomization assembly 20 according to one embodiment may have a physical double barrier (i.e., the first liquid delivery element 310 and the second liquid delivery element 320) for preventing particles that are not vaporized from being directly inhaled into a user's oral cavity. As a result, the aerosol generating assembly 20 may effectively prevent the splatter of droplets.

According to one embodiment, the second liquid delivery element 320 may be formed in a disk shape as a whole. However, this is an example, and the second liquid delivery element 320 may also be formed in a rectangular parallelepiped shape as long as the second liquid delivery element 320 may function as a physical barrier to prevent the splatter of droplets.

The second liquid delivery element 320 may be disposed between the first liquid delivery element 310 and the atomizer 400. Accordingly, the second liquid delivery element 320 may receive an aerosol generating material from the first liquid delivery element 310 and deliver the aerosol generating material to the atomizer 400.

The second liquid delivery element 320 may have one surface in contact with the atomizer 400 and the other surface in contact with the delivery portion 312. The second liquid delivery element 320 may be supported by the atomizer 400 by having one surface in contact with the atomizer 400.

The one surface of the second liquid delivery element 320 in contact with the atomizer 400 may have a smaller size than the one side 400*a* of the atomizer 400. However, according to one embodiment, the one surface of the second liquid delivery element 320 may have the same size as the one side 400*a* of the atomizer 400 or may be larger than the one side 400*a* of the atomizer 400.

The second liquid delivery element 320 may be formed of a material capable of absorbing an aerosol generating material. Accordingly, both of the first liquid delivery element 310 and the second liquid delivery element 320 may absorb an aerosol generating material, and thus the overall absorption capacity of the atomization assembly 20 according to one embodiment may be increased. Therefore, the atomization assembly 20 according to one embodiment may effectively prevent an aerosol generating material from leaking to the outside.

The second liquid delivery element 320 may include a wick including at least one of cotton fiber, ceramic fiber, glass fiber, and porous ceramic but is not limited thereto. The second liquid delivery element 320 may maintain the aerosol generating material in an optimal state for conversion into an aerosol.

For example, the second liquid delivery element 320 may include any one material of SPL 30(H), SPL 50(H)V, NP 100(V8), SPL 60(FC), and melamine.

According to one embodiment, the second liquid delivery element 320 may include a material different from a material of the first liquid delivery element 310, but it is not limited thereto. In another embodiment, the second liquid delivery element 320 may also include the same material as the first liquid delivery element 310.

Hereinafter, various embodiments of the first liquid delivery element 310 and the second liquid delivery element 320 will be described.

In a first embodiment, the first liquid delivery element 310 may have a greater absorption capacity than the second liquid delivery element 320. Accordingly, the atomization assembly 20 according to one embodiment may increase an absorption capacity and a delivery capacity of an aerosol generating material.

This may be proved by Experiment 1 as described below.

Experiment 1

First, a test piece is conditioned for 24 hours in an experiment space of 20.0° C. and relative humidity of 65.0%. Here, the test piece may be the first liquid delivery element 310 or the second liquid delivery element 320.

Next, a mass of the conditioned test piece is measured.

Next, the test piece is soaked in liquid. The liquid here may be an aerosol generating material (e.g., water).

Next, the soaked test piece is held vertically until the liquid does not drip for more than 30 seconds.

Next, when the liquid does not drip for more than 30 seconds, the mass of the test piece is measured.

Next, the above process is repeated after changing a material of the test piece, and a rate of increase in mass of the material is recorded.

Table 3 below shows results of Experiment 1.

TABLE 3

| Test piece | Mass (g) of material before experiment | Mass (g) of material after experiment | Rate (%) of increase in mass of material |
|---|---|---|---|
| SPL 30(H) | 0.337 | 3.901 | 1057.57 |
| SPL 50(H)V | 0.594 | 6.590 | 1009.43 |
| NP 100(V8) | 1.070 | 13.110 | 1125.23 |
| SPL 60(FC) | 1.624 | 18.693 | 1151.05 |
| melamine | 1.924 | 20.779 | 1079.99 |

In Table 3 above, the rate of increase in mass of a material may be proportional to an absorption capacity of the test piece. As can be seen from Table 3 above, the highest rate of increase in mass of the material appears when the specimen is SPL 60. Therefore, the overall absorption capacity of the atomization assembly 20 may be improved when the first liquid delivery element 310 includes the SPL 60 material, In addition, when the first liquid delivery element 310 has a higher absorption capacity than the second liquid delivery element 320, there may be a difference in density of an aerosol generating materials absorbed by the first liquid delivery element 310 and the second liquid delivery element 320.

According to the atomization assembly 20 according to an embodiment, an aerosol generating material may be smoothly delivered from the first liquid delivery element 310 to the second liquid delivery element 320 due to the difference in density. Therefore, the atomization assembly 20 according to one embodiment may increase an atomization rate by increasing a delivery capacity of an aerosol generating material.

In one example, when the first liquid delivery element 310 includes the SPL 60 material, the second liquid delivery element 320 may include a melamine material. In another example, when the first liquid delivery element 310 includes the SPL 60 material, the second liquid delivery element 320 may include an SPL 50(H) material.

An embodiment in which the first liquid delivery element 310 has a higher absorption capacity than the second liquid delivery element 320 may be implemented by other combinations of materials in addition to the two combinations described above.

In a second embodiment, the first liquid delivery element 310 may include a material with a higher absorption rate than the second liquid delivery element 320. Accordingly, the atomization assembly 20 according to one embodiment may increase an atomization rate at which an aerosol generating material is atomized and a delivery capacity for the aerosol generating material.

This may be proved by Experiment 2 and Experiment 3 as described below.

Experiment 2

First, a test piece of 2.5 cm (width)×13.0 cm (length) and a beaker containing immersion liquid of 180 ml are prepared. Here, the test piece may be the first liquid delivery element 310 or the second liquid delivery element 320. The immersion liquid may be an aerosol generating material (e.g., water).

Next, a portion of the test piece which is 1 cm from the top is grabbed by using tweezers or so on, and the bottom 1 cm portion of the test piece is immersed in the immersion liquid.

Next, after the test piece is immersed for 5 minutes, a height of the test piece in which the immersion liquid is absorbed is measured.

Next, the above process is repeated after changing a material of the test piece, and heights of the test piece in which the immersion liquid is absorbed are recorded.

Table 4 below shows results of Experiment 2.

TABLE 4

| Test piece | Height (cm) of test piece with absorbed immersion liquid |
|---|---|
| SPL 30(H) | 1.7 |
| SPL 50(H)V | 1.9 |
| NP 100(V8) | 3.3 |
| SPL 60(FC) | 3.7 |
| melamine | 3.1 |

A height of the test piece in which an immersion liquid is absorbed may be proportional to an absorption rate at which an aerosol generating material is absorbed by the test piece.

Experiment 3

First, a test piece of 2.5 cm (width)×13.0 cm (length) and a beaker containing immersion liquid of 180 ml are prepared. Here, the test piece may be the first liquid delivery element 310 or the second liquid delivery element 320. In addition, the immersion liquid may be an aerosol generating material (e.g., water).

Next, a portion of the test piece which is 1 cm from the top is grabbed by using tweezers, and the 1 cm bottom portion of the test piece is immersed in the immersion liquid.

Next, after the test piece is immersed for 5 minutes, the time taken for the immersion liquid to climb 1 cm on the test piece (up to 2 cm from the bottom of the test piece) is measured.

Next, the above process is repeated after changing a material of the test piece, and times taken for the immersion liquid to be absorbed are recorded.

Table 5 below shows results of Experiment 3.

TABLE 5

| Test piece | Time (in seconds) taken for immersion liquid to be absorbed |
|---|---|
| SPL 30(H) | 389 |
| SPL 50(H)V | 64 |
| NP 100 (V8) | 68 |
| SPL 60(FC) | 45 |
| melamine | 71 |

Time taken for the immersion liquid to be absorbed may be inversely proportional to an absorption rate at which an aerosol generating material is absorbed by the test piece. That is, the shorter the time taken for the aerosol generating material to be absorbed into the test piece, the faster the absorption rate. As can be seen from Table 4 and Table 5 above, the highest absorption rate appears when the test piece is SPL 60(FC). Therefore, as can be seen from Table 4 and Table 5 above, if the first liquid delivery element 310 includes the SPL 60 material, the overall absorption rate of the atomization assembly 20 may be increased. As a result, an atomization rate at which an aerosol generating material is atomized may be increased. In addition, when the first liquid delivery element 310 has a higher absorption rate than the second liquid delivery element 320, there may be a difference in density of an aerosol generating material absorbed by the first liquid delivery element 310 and the second liquid delivery element 320. Accordingly, in the atomization assembly 20 according to one embodiment, an aerosol generating material may be smoothly transferred from the first liquid delivery element 310 to the second liquid delivery element 320 due to the difference in density.

In one example, when the first liquid delivery element 310 includes the SPL 60 material, the second liquid delivery element 320 may include a melamine material. In another example, when the first liquid delivery element 310 includes the SPL 60 material, the second liquid delivery element 320 may also include the SPL 50(H) material.

An embodiment in which the first liquid delivery element 310 has a higher absorption rate than the second liquid delivery element 320 may be implemented by other combinations in addition to the two combinations described above.

The atomization assembly 20 according to one embodiment may further include a second support member 340.

The second support member 340 accommodates the atomizer 400, the first liquid delivery element 310, and the second liquid delivery element 320. The second support member 340 may completely surround the atomizer 400, the first liquid delivery element 310, and the second liquid delivery element 320. The second support member 340 may protect the atomizer 400, the first liquid delivery element 310, and the second liquid delivery element 320 from the outside. The atomizer 400, the first liquid delivery element 310, and the second liquid delivery element 320 may be accommodated in the second support member 340 and may be supported by the second support member 340.

For example, the second support member 340 may include a soft rubber material with a hardness of about 20 N/mm2 or more and about 85 N/mm2 or less. In this case, the hardness of the second support member 340 may be measured by Shore A, which is a type of hardness measuring instrument for measuring hardness of a non-metal material such as a soft rubber material or a soft plastic material.

The second support member 340 may have a hollow cylindrical shape as a whole, but this is just an example. The second support member 340 may have another shape, such as a rectangular parallelepiped shape, which may accommodate the atomizer 400, the first liquid delivery element 310, and the second liquid delivery element 320.

The second support member 340 may include an accommodation space 340*a* for accommodating the atomizer 400, the first liquid delivery element 310, and the second liquid delivery element 320. The accommodation space 340*a* may be formed inside the accommodation main body 341. The accommodation main body 341 may form an outer shape of the second support member 340.

The accommodation space 340*a* may include a first accommodation space for accommodating the first liquid delivery element 310, a second accommodation space for accommodating the second liquid delivery element 320, and a third accommodation space for accommodating the atomizer 400. For example, the third accommodation space, the second accommodation space, and the first accommodation space may be in fluid communication with each other. In addition, shapes of the third accommodation space, the second accommodation space, and the first accommodation space may respectively correspond to shapes of the atomizer 400, the second liquid delivery element 320, and the first liquid delivery element 310.

The second support member 340 may include a separation space 340*b*.

The separation space 340*b* may be formed between the accommodation main body 341 and the second liquid delivery element 320. In this case, one end and the other end of the first liquid delivery element 310 may protrude from the second liquid delivery element 320 to cover the separation space 340*b*. That is, the first liquid delivery element 310 may extend longer than the second liquid delivery element 320 in the second direction.

Accordingly, the atomization assembly 20 according to one embodiment may prevent non-vaporized particles from escaping the separation space 340*b*, thereby reducing a possibility of the splatter of droplets. The separation space 340*b* may be a part of the second accommodation space.

Referring to FIG. 10, the second support member 340 may include a connection space 340*c*.

The connection space 340*c* is a space in which an aerosol generating material is transferred or delivered from a reservoir to the first liquid delivery element 310 accommodated in the second support member 340. The connection space 340*c* may provide fluid communication between the reservoir and the first liquid delivery element 310. The connection space 340*c* may be formed in the accommodation main body 341 at a portion where the absorbent portions 311 is located. The connection space 340*c* may have a shape corresponding to the absorbent portion 311.

According to one embodiment, the second support member 340 may further include a first support surface 341*a*.

The first support surface 341*a* supports the first liquid delivery element 310. The first liquid delivery element 310 may have one end and the other end supported by the first support surface 341*a*. Accordingly, the second liquid delivery element 320 may be maintained between the atomizer 400 and the first liquid delivery element 310 to stably prevent the splatter of droplets.

The first support surface 341*a* may support one end and the other end of the first liquid delivery element 310. For example, the first support surface 341*a* may support the absorbent portions 311.

The first support surface 341*a* may face the first accommodation space. The first support surface 341*a* may be formed inside the accommodation main body 341.

Referring to FIG. 10, the second support member 340 may further include a second support surface 341*b*.

The second support surface 341*b* may support the atomizer 400. The second support surface 341*b* may face the third accommodation space. The second support surface 341*b* may be formed inside the accommodation main body 341 at a position spaced apart from the first support surface 341*a*.

Referring to FIG. 10, the second support member 340 may further include a protrusion 343.

The protrusion 343 may be formed on an outer surface of the accommodation main body 341. The protrusion 343 may be in contact with an inner surface of a housing. In the atomization assembly 20 according to one embodiment, the protrusion 343 may prevent an aerosol generating material from leaking between the second support member 340 and the housing.

The protrusion 343 may extend along a circumferential direction of the outer surface of the accommodation main body 341. A plurality of the protrusions 343 may be formed in the first direction. The protrusion 343 may be formed integrally with the accommodation main body 341.

The protrusion 343 may be formed on a lower surface (i.e., bottom surface) of the accommodation main body 341. A plurality of the protrusions 343 may be formed on the lower surface of the accommodation main body 341.

FIGS. 12A to 12D are views illustrating various embodiments of the liquid delivery element.

Figure 12A:
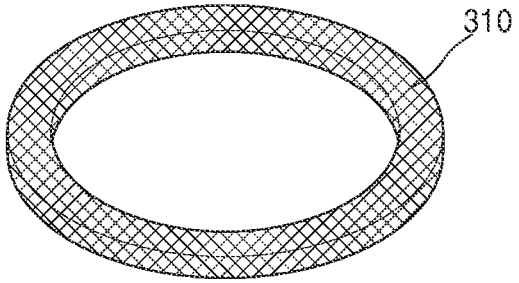
FIG. 12A is a perspective view illustrating a first liquid delivery element according to an embodiment.
Figure 12B:
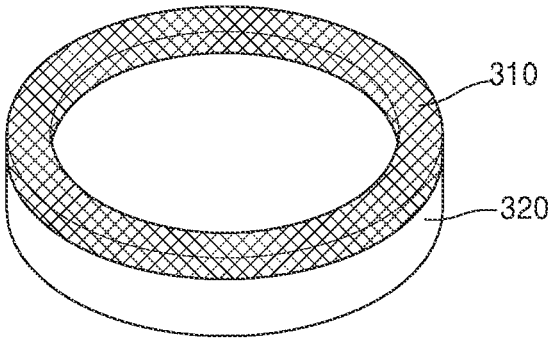
FIG. 12B is a perspective view illustrating a state in which a first liquid delivery element and a second liquid delivery element in FIG. 12A are connected to each other.
Figure 12C:
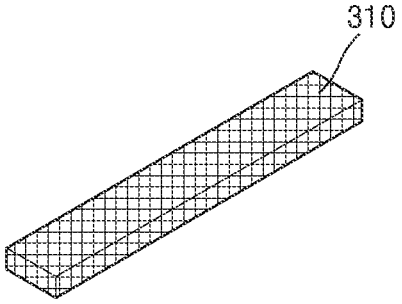
FIG. 12C is a perspective view illustrating a first liquid delivery element according to another embodiment.
Figure 12D:
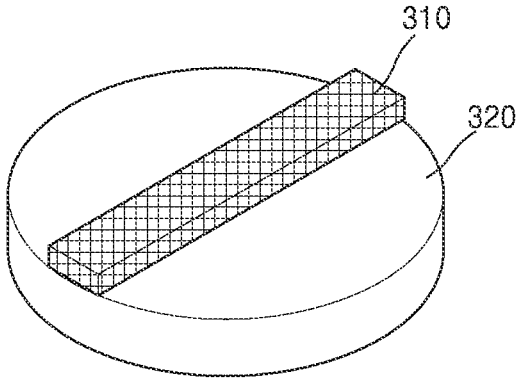
FIG. 12D is a perspective view illustrating a state in which the first liquid delivery element of FIG. 12C is connected to a second liquid delivery element.

FIG. 12A is a perspective view illustrating a first liquid delivery element according to one embodiment, and FIG. 12B is a perspective view illustrating a state in which the first liquid delivery element of FIG. 12A is connected to a second liquid delivery element. In addition, FIG. 12C is a perspective view illustrating a first liquid delivery element according to another embodiment, and FIG. 12D is a perspective view illustrating a state in which the first liquid delivery element of FIG. 12C is connected to a second liquid delivery element.

Table 6 below shows an experimental result representing an atomization rate, an atomization amount, and a degree of droplet splatter according to a shape and a material of the liquid delivery element. Table 6 below shows an experimental result under the condition that the second liquid delivery element 320 includes a melamine material, and the second liquid delivery element 320 has a disk shape as a whole.

TABLE 6

| Liquid delivery element | Material | Atomization rate (sec) | Atomization amount (g/3 sec) | Droplet splatter |
|---|---|---|---|---|
| First embodiment (FIG. 12A) | Melamine | 2.3 | 0.050 | Yes |
| Second embodiment (FIG. 12B) | Melamine | 2.7 | 0.055 | Slightly |
| Third embodiment (FIG. 12C) | Melamine | 3.2 | 0.001 to 0.002 | Yes |
| Fourth embodiment (FIG. 12D) | Melamine | 2.6 | 0.055 | No |
| Fifth embodiment (FIG. 12C) | SPL 60 | 3.6 | 0.003 to 0.004 | Yes |
| Sixth embodiment (FIG. 12D) | SPL 60 | 1.7 | 0.06 | No |

In Table 6 above, the atomization rate indicates the time taken for an aerosol to be generated from an aerosol generating material, and the atomization amount (g) indicates the amount of an aerosol generated for the same time (for example, 3 seconds). The droplet splatter indicates whether or not a user may feel non-vaporized particles when smoking. In a first embodiment, the atomization assembly 20 may include only the first liquid delivery element 310. In addition, in the first embodiment, the first liquid delivery element 310 may have a circular ring shape as a whole. In a second embodiment, the atomization assembly 20 may include a first liquid delivery element 310 and a second liquid delivery element 320. In addition, in the second embodiment, the first liquid delivery element 310 may have a circular ring shape as a whole and may be arranged to overlap the edge of the second liquid delivery element 320.

In third and fifth embodiments, the atomization assembly 20 may include only the first liquid delivery element 310. In addition, in the third and fifth embodiments, the first liquid delivery element 310 may have a rectangular parallelepiped shape as a whole and may extend in the second direction.

In fourth and sixth embodiments, the atomization assembly 20 may include the first liquid delivery element 310 and the second liquid delivery element 320. In addition, in the fourth and sixth embodiments, the first liquid delivery element 310 may have a rectangular parallelepiped shape as a whole and may extend in the second direction. In this case, the first liquid delivery element 310 may be arranged to overlap the center of the second liquid delivery element 320.

The experimental results of the above embodiments are sequentially reviewed as follows.

First, referring to Table 6 above, it can be seen that the atomization rates in the fourth and sixth embodiments are relatively fast.

In addition, referring to Table 6 above, it can be seen that the atomization rate in the sixth embodiment is faster than the atomization rate in the fourth embodiment, which is due to a difference in material of the first liquid delivery element 310. This means that the atomization rate is related to an absorption rate demonstrated through Experiment 2 and Experiment 3.

Second, referring to Table 6 above, it can be seen that the atomization amounts in the second, fourth, and sixth embodiments are relatively large. This may be due to the fact that the atomization assembly 20 according to the second, fourth, and sixth embodiments has a higher absorption capacity than the embodiment including only the first liquid delivery element 310.

In addition, referring to Table 6 above, it can be seen that the atomization amount in the sixth embodiment is larger than the atomization amount in the fourth embodiment, which may be due to a difference in material of the first liquid delivery element 310. That is, when the first liquid delivery element 310 includes the SPL 60 material, a larger amount of atomization may be generated compared to a case in which the first liquid delivery element 310 includes the melamine material.

Third, referring to Table 6 above, it can be seen that the degree of droplet splatter in the second, fourth, and sixth embodiments is relatively low. This may be due to the fact that the atomization assembly 20 according to the second, fourth, and sixth embodiments covers a larger area where the droplet splatter occurs compared to the embodiment including only the first liquid delivery element 310.

In addition, referring to Table 6 above, it can be seen that the degree of droplet splatter in the fourth and sixth embodiments is higher than in the second embodiment. This may be due to the fact that the first liquid delivery element 310 extends in the second direction and is arranged at a central portion 320*b* of the second liquid delivery element 320.

That is, according to the second embodiment, the first liquid delivery element 310 is in the edge portion 320*a* (see FIG. 11) of the second liquid delivery element 320, and thus an aerosol generating material may be concentrated on the edge portion 320*a* of the second liquid delivery element 320. Therefore, the second embodiment may increase a possibility that the aerosol generating material leaks into the edge portion 320*a* of the second liquid delivery element 320, and a possibility that the droplet splatter occurs through the edge portion 320*a* of the second liquid delivery element 320.

In contrast, according to the fourth and sixth embodiments, the first liquid delivery element 310 extends in the second direction and is arranged at the central portion 320*b* of the second liquid delivery element 320. Thus, an aerosol generating material may be concentrated in the central portion 320*b* of the second liquid delivery element 320. Therefore, the fourth and sixth embodiments may reduce a possibility that an aerosol generating material leaks into the edge portion 320*a* of the second liquid delivery element 320, and a possibility that the droplet splatter occurs through the edge portion 320*a* of the second liquid delivery element 320.

Figure 13:
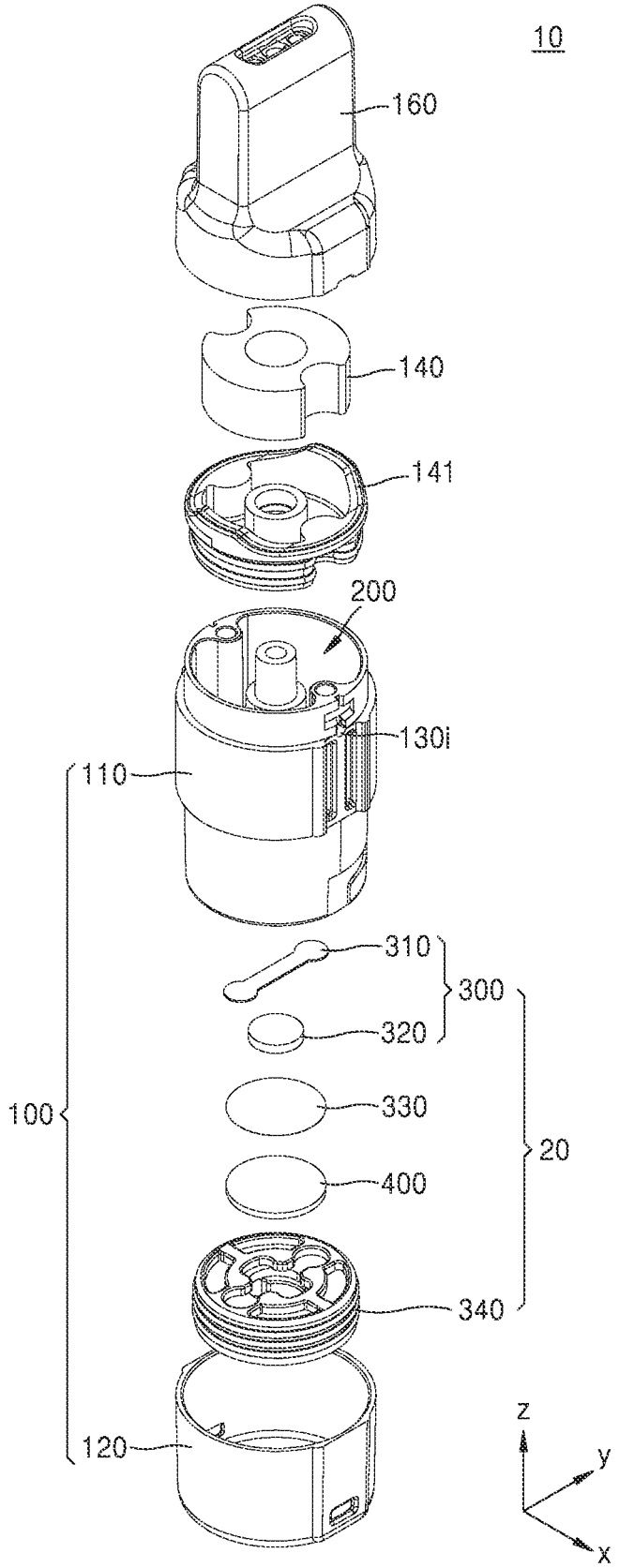
FIG. 13 is an exploded perspective view of a cartridge according to another embodiment.
Figure 14:
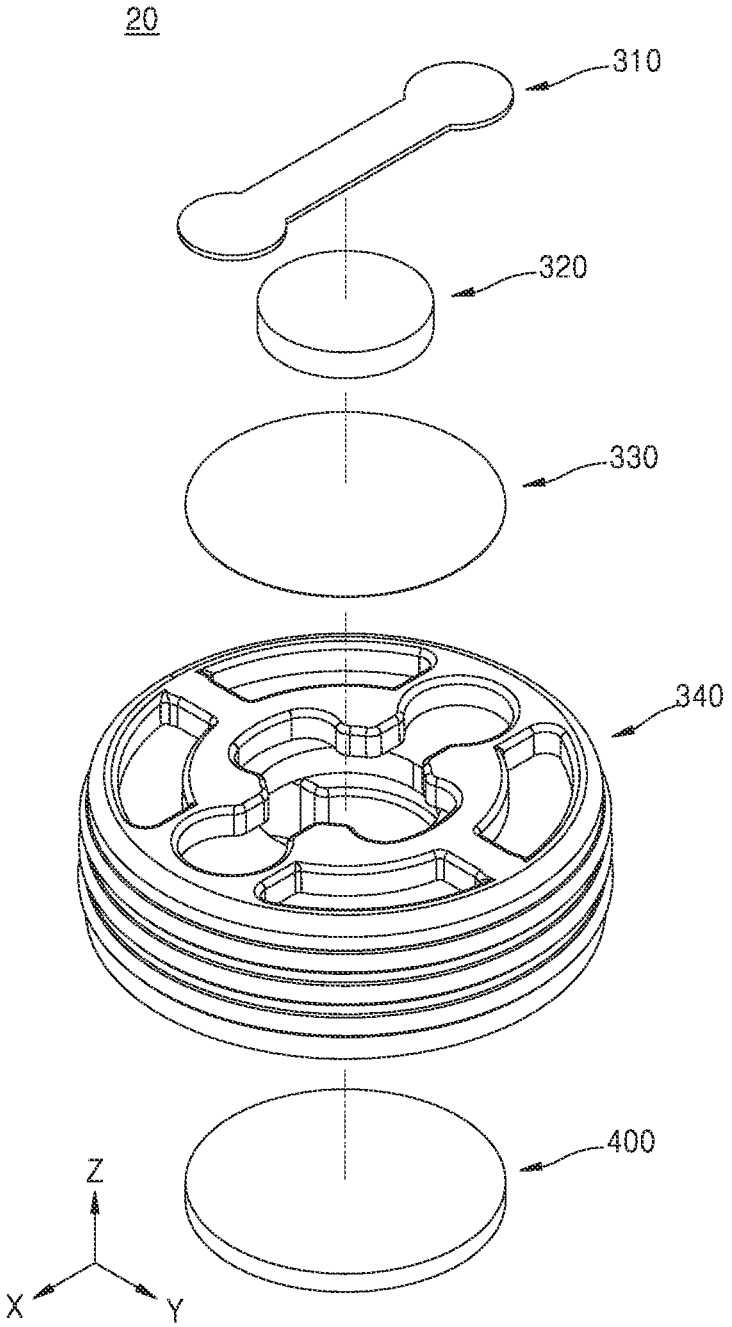
FIG. 14 is a schematic perspective view of an atomization assembly for an aerosol generating device according to another embodiment.

FIG. 13 is an exploded perspective view of a cartridge according to another embodiment, and FIG. 14 is a schematic perspective view of an atomization assembly according to another embodiment.

Figure 15:
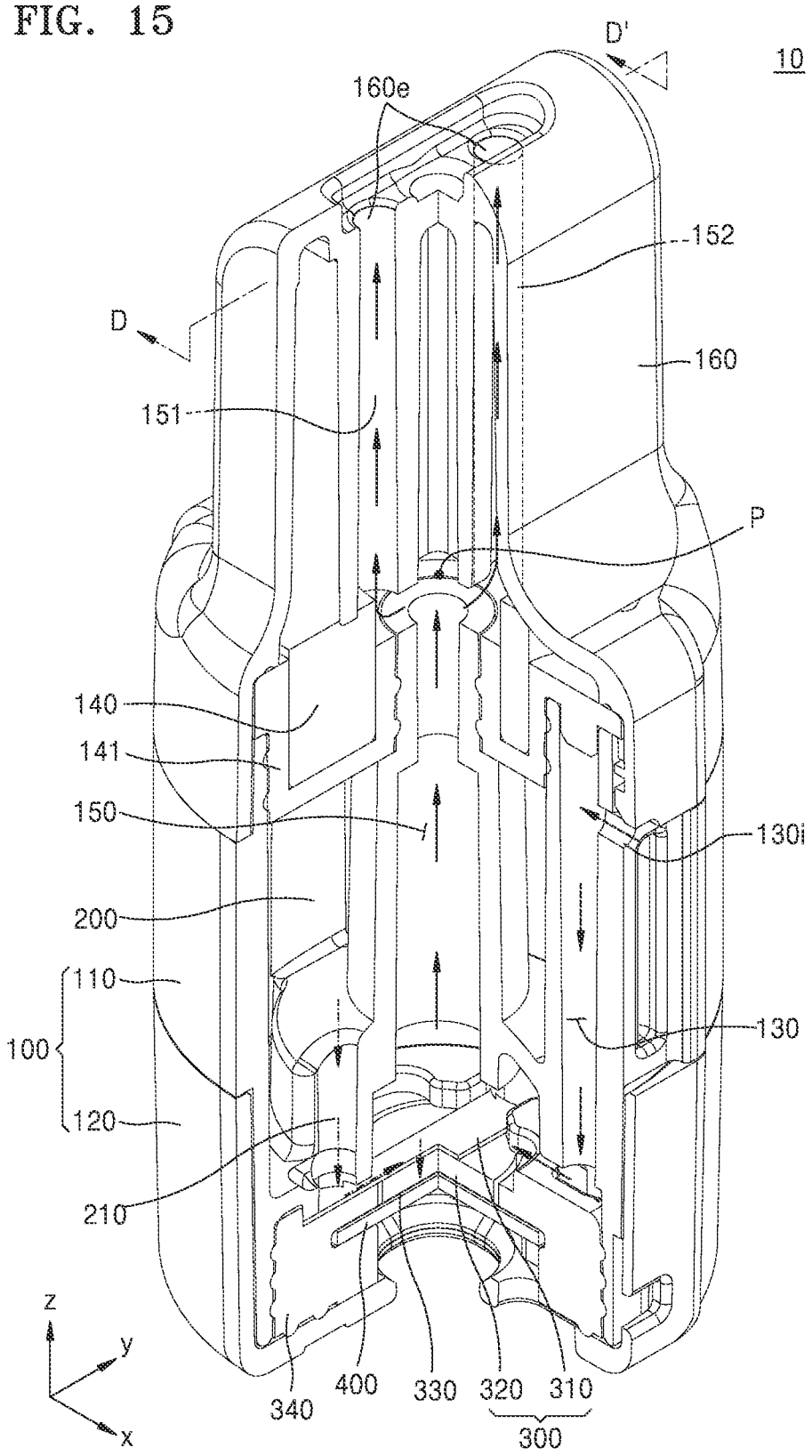
FIG. 15 is a perspective view illustrating the inside of a partial region of a cartridge according to another embodiment.
Figure 16:
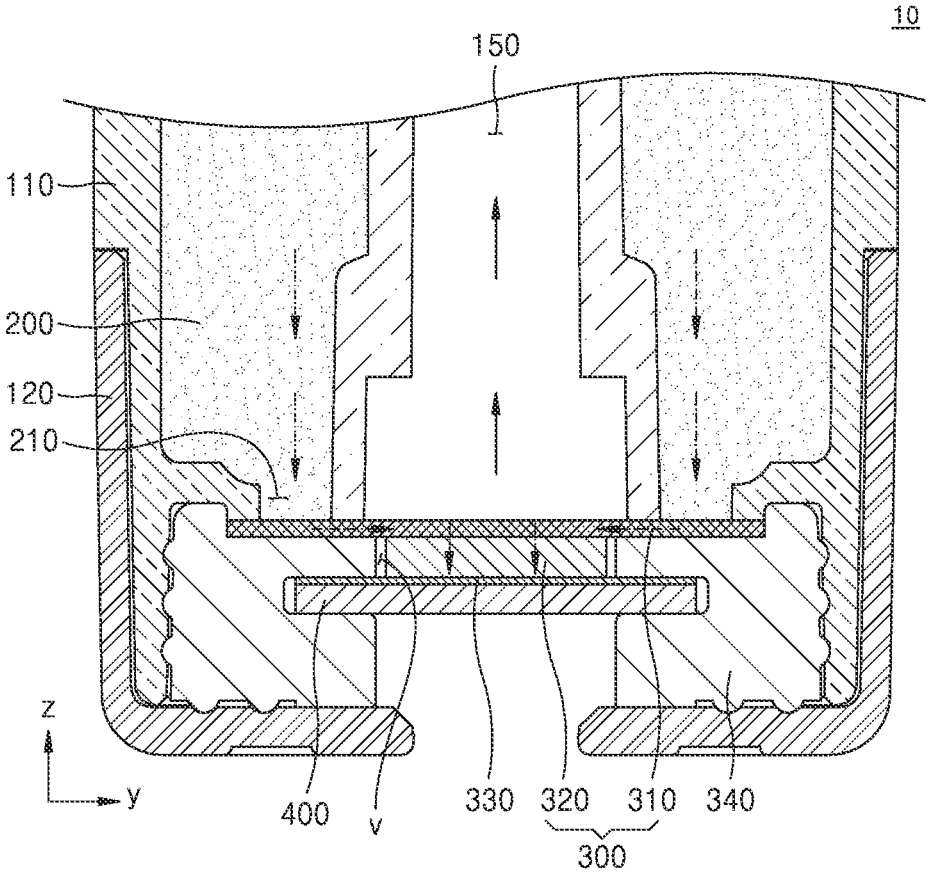
FIG. 16 is a cross-sectional view of the cartridge illustrated in FIG. 15 taken along a direction D-D'.

In addition, FIG. 15 is a perspective view illustrating the inside of a partial region of a cartridge according to another embodiment, and FIG. 16 is a cross-sectional view of the cartridge in FIG. 15 taken along direction D-D'.

In FIGS. 13, 15, and 16, alternate long and short dash lines indicate movement paths of aerosol generating materials, dashed lines indicate movement paths of external air, and solid lines indicate movement paths of an aerosol.

Referring to FIGS. 13 to 16, a cartridge 10 according to an embodiment may include an atomization assembly 20, a housing 100, an air inlet passage 130, a structure 140, a first support member 141, an outlet passage 150, a mouthpiece 160, and a reservoir 200.

The atomization assembly 20 may include a first liquid delivery element 310, a second liquid delivery element 320, a vibration transmission pad 330, a second support member 340 (or a "support member"), and an atomizer 400.

The cartridge 10 according to the embodiment may further include the vibration transmission pad 330 in addition to the atomization assembly 20 of the cartridge 10 illustrated in FIGS. 6, 7, and 8. Thus, redundant descriptions of the other elements are omitted hereinafter.

The vibration transmission pad 330 may be arranged between the liquid delivery element 300 and the atomizer 400 and serve as a medium for transmitting ultrasonic vibrations generated by the atomizer 400 to the liquid delivery element 300. The vibration transmission pad 330 may include, for example, a material with a certain hardness to operate as a medium for transmitting ultrasonic vibrations, but it is not limited thereto.

One surface (for example, a surface facing the z direction) of the vibration transmission pad 330 may be in contact with the second liquid delivery element 320 and the other surface (for example, a surface facing the −z direction) may be in contact with the atomizer 400, thereby transmitting the ultrasonic vibrations generated by the atomizer 400 to the second liquid delivery element 320.

According to one embodiment, a liquid aerosol generating material stored in the reservoir 200 may move in a direction toward the first liquid delivery element 310 along the connection passage 210, and the first liquid delivery element 310 may absorb an aerosol generating material supplied from the reservoir 200.

The aerosol generating material absorbed by the first liquid delivery element 310 may move in a horizontal direction (for example, the y-axis direction) along the first liquid delivery element 310, and then may be delivered to the second liquid delivery element 320 in contact with the first liquid delivery element 310. In other words, the aerosol generating material stored in the reservoir 200 may be delivered to the second liquid delivery element 320 via the first liquid delivery element 310.

The aerosol generating material supplied from the first liquid delivery element 310 to the second liquid delivery element 320 may be divided into fine particles by the ultrasonic vibrations transmitted from the vibration transmission pad 330.

The fine particles may be mixed with external air introduced into the atomizer 400 from the outside of the cartridge 10 through the air inlet passage 130 to generate an aerosol, and the generated aerosol may be discharged to the outside of the cartridge 10 through the outlet passage 150 to be supplied to a user.

According to one embodiment, the vibration transmission pad 330 may minimize a loss of ultrasonic vibrations and may have substantially the same area as the atomizer 400 to effectively transmit the ultrasonic vibrations generated by the atomizer 400 to the second liquid delivery element 320. For example, the vibration transmission pad 330 may correspond to the atomizer 400 when viewed in the z axis direction.

However, the shape of the vibration transmission pad 330 is not limited to the embodiment described above. In another embodiment, the vibration transmission pad 330 may have a smaller area or a larger area than the atomizer 400.

According to one embodiment, the vibration transmission pad 330 may also serve to prevent a liquid aerosol generating material supplied to the second liquid delivery element 320 from coming into direct contact with the atomizer 400.

When the liquid aerosol generating material comes into direct contact with the atomizer 400, some aerosol generating material may flow into an electrical connection member (for example, a pogo pin) that connects the atomizer 400 to a main body (for example, the main body 20 of FIG. 2), which may cause a failure or an abnormal operation of the cartridge 10.

As described above, the cartridge 10 according to one embodiment may minimize a failure or an abnormal operation of the cartridge 10 that may occur as the liquid aerosol generating material comes into direct contact with the atomizer 400, by using the vibration transmission pad 330.

According to one embodiment, the vibration transmission pad 330 may be arranged inside the second support member 340. For example, the vibration transmission pad 330 may be accommodated in an accommodation space (for example, the accommodation space 340*a* of FIG. 10) of the second support member 340.

According to one embodiment, the vibration transmission pad 330 may be larger than the atomizer 400 and the second liquid delivery element 320. Accordingly, the atomization assembly 20 according to another embodiment may increase a region that blocks a direct contact between the atomizer 400 and the second liquid delivery element 320.

In addition, the vibration transmission pad 330 may have a disk shape as a whole. However, this is just an example, and the vibration transmission pad 330 may have another shape as long as the vibration transmission pad 330 is located between the atomizer 400 and the second liquid delivery element 320.

For example, the vibration transmission pad 330 may include a stainless material, but it is not limited thereto.

The cartridge and the aerosol generating device including the same, according to the embodiments described above, may generate an aerosol at a relatively low temperature by using ultrasonic vibrations, compared to when vaporizing the aerosol generating material by using a heater. Thus, a user's smoking sensation may be improved.

In addition, the cartridge and the aerosol generating device including the same, according to the embodiments described above, may prevent droplets from splattering and reaching a user's mouth, and thus a user's smoking sensation may be improved.

In addition, the cartridge and the aerosol generating device including the same, according to the embodiments described above, may prevent an aerosol generating material from leaking, and thus a failure or an abnormal operation of the cartridge or the aerosol generating device may be reduced.

One embodiment may also be implemented in the form of a recording medium including instructions executable by a computer, such as a program module executable by the computer. The computer-readable recording medium may be any available medium that can be accessed by a computer, including both volatile and nonvolatile media, and both removable and non-removable media. In addition, the computer-readable recording medium may include both a computer storage medium and a communication medium. The computer storage medium includes all of volatile and nonvolatile media, and removable and non-removable media implemented by any method or technology for storage of information such as computer-readable instructions, data structures, program modules, or other data. The communication medium typically includes computer-readable instructions, data structures, other data in modulated data signals such as program modules, or other transmission mechanisms, and includes any information transfer media.

Those of ordinary skill in the art related to the present embodiments may understand that various changes in form and details can be made therein without departing from the scope of the characteristics described above. Therefore, the disclosed methods should be considered in a descriptive point of view, not a restrictive point of view. The scope of the present disclosure is defined by the appended claims rather than by the foregoing description, and all differences within the scope of equivalents thereof should be construed as being included in the present disclosure.

The invention claimed is:

1. A cartridge for an aerosol generating device, comprising:

a housing;

a reservoir located inside the housing and configured to store an aerosol generating material in a liquid state;

an atomizer located inside the housing and configured to generate ultrasonic vibrations to atomize the aerosol generating material into an aerosol; and a plurality of liquid delivery elements configured to absorb the aerosol generating material stored in the reservoir and deliver the absorbed aerosol generating material to the atomizer, wherein the plurality of liquid delivery elements comprise:

a first liquid delivery element arranged adjacent to the reservoir and configured to receive the aerosol generating material from the reservoir; and a second liquid delivery element that is located between the first liquid delivery element and the atomizer and configured to deliver the aerosol generating material from the first liquid delivery element to the atomizer, and wherein the first liquid delivery element and the second liquid delivery element are arranged to block droplets splattering from the atomizer toward the outside of the cartridge, and wherein the bottom surface of the first liquid delivery element is facing the upper surface of the second liquid delivery element and extending horizontally along the entire width of the upper surface of the second liquid delivery element and intersecting the path of aerosol toward the outside of the cartridge.

2. The cartridge of claim 1, further comprising:

a mouthpiece including an outlet for discharging the aerosol to an outside; and an outlet passage arranged to provide fluid communication between the atomizer and the outlet, wherein the aerosol generated by the atomizer moves toward the outlet along the outlet passage.

3. The cartridge of claim 1, further comprising:

a vibration transmission pad located between the second liquid delivery element and the atomizer, and configured to transmit vibrations generated by the atomizer to the second liquid delivery element.

4. The cartridge of claim 1, further comprising:

at least one air inlet passage which is in fluid communication with an outside of the housing such that external air is introduced into the housing through the at least one air inlet passage.

5. The cartridge of claim 4, wherein the at least one air inlet passage includes:

a first air inlet passage including a first air inlet hole formed in one region of the housing; and a second air inlet passage including a second air inlet hole formed in another region of the housing, wherein the first air inlet passage is spaced apart from the second air inlet passage in a circumferential direction of the housing.

6. An aerosol generating device comprising:

the cartridge according to claim 1;

a main body connected to the cartridge;

a battery that is arranged inside the main body and supplies electric power to the cartridge; and a processor that is arranged inside the main body and controls the electric power supplied to the cartridge from the battery.

* * * * *